US012428122B1

(12) United States Patent
Tornbaum et al.

(10) Patent No.: US 12,428,122 B1
(45) **Date of Patent: *Sep. 30, 2025**

(54) METHODS FOR A MARINE VESSEL WITH PRIMARY AND AUXILIARY PROPULSION DEVICES

(71) Applicant: Brunswick Corporation, Mettawa, IL (US)

(72) Inventors: Andres Perdomo Tornbaum, Neenah, WI (US); Kenneth G. Gable, Oshkosh, WI (US); Conor A. Leehaug, Appleton, WI (US)

(73) Assignee: Brunswick Corporation, Mettawa, IL (US)

( * ) Notice: Subject to any disclaimer, the term of this patent is extended or adjusted under 35 U.S.C. 154(b) by 124 days.

This patent is subject to a terminal disclaimer.

(21) Appl. No.: 18/485,427

(22) Filed: Oct. 12, 2023

Related U.S. Application Data

(63) Continuation-in-part of application No. 18/315,323, filed on May 10, 2023, and a continuation-in-part of (Continued)

(51) Int. Cl.
*B63H 25/42* (2006.01)

(52) U.S. Cl.
CPC ..... *B63H 25/42* (2013.01); *B63H 2025/425* (2013.01)

(58) Field of Classification Search
CPC ..... B63H 25/42; B63H 2025/425
See application file for complete search history.

(56) References Cited

U.S. PATENT DOCUMENTS 4,294,186 A 10/1981 Wardell
5,131,875 A 7/1992 Lee
(Continued)

FOREIGN PATENT DOCUMENTS

CA 2979909 A1 8/2018
EP 1611007 B1 8/2007
(Continued)

OTHER PUBLICATIONS

Max Power, "Retractable Thrusters," web page, last visited Feb. 11, 2020, available at https://www.max-power.com/category/14-retractable-thrusters.

(Continued)

*Primary Examiner* — Hunter B Lonsberry
*Assistant Examiner* — Harrison Heflin
(74) *Attorney, Agent, or Firm* — Andrus Intellectual Property Law, LLP

(57) ABSTRACT

A method for a marine vessel includes determining if a first propulsion device on the marine vessel is rotated about a horizontal tilt/trim axis above a predetermined threshold and determining if a second propulsion device on the marine vessel is deployed. If the second propulsion device is deployed, the method includes retracting the second propulsion device in response to determining that the first propulsion device is rotated above the predetermined threshold. If the second propulsion device is not deployed, the method includes prohibiting the second propulsion device from being deployed in response to determining that the first propulsion device is rotated above the predetermined threshold.

19 Claims, 11 Drawing Sheets

Related U.S. Application Data application No. 16/984,617, filed on Aug. 4, 2020, now Pat. No. 11,827,319.

(56) References Cited

U.S. PATENT DOCUMENTS

| | | | |
|---|---|---|---|
| 5,152,240 | A | 10/1992 | Fontanille |
| 6,142,841 | A | 11/2000 | Alexander, Jr. et al. |
| 6,280,267 | B1 | 8/2001 | Griffith, Sr. et al. |
| 6,454,620 | B1 | 9/2002 | Theisen et al. |
| 6,583,728 | B1 | 6/2003 | Staerzl |
| 6,592,412 | B1 | 7/2003 | Geil et al. |
| 6,659,817 | B1 | 12/2003 | Anderson et al. |
| 6,857,917 | B1 | 2/2005 | Wasilewski |
| 7,004,803 | B2 | 2/2006 | Ruffe |
| 7,143,363 | B1 | 11/2006 | Gaynor et al. |
| 7,150,662 | B1 | 12/2006 | Janitz |
| 7,150,664 | B1 | 12/2006 | Uppgard et al. |
| 7,156,709 | B1 | 1/2007 | Staerzl et al. |
| 7,188,581 | B1 | 3/2007 | Davis et al. |
| 7,255,616 | B1 | 8/2007 | Caldwell |
| 7,294,031 | B1 | 11/2007 | Davis et al. |
| 7,370,599 | B1 | 5/2008 | Berman et al. |
| 7,381,108 | B1 | 6/2008 | Salmon |
| 7,398,742 | B1 | 7/2008 | Gonring |
| 7,416,456 | B1 | 8/2008 | Gonring et al. |
| 7,467,595 | B1 | 12/2008 | Lanyi et al. |
| 7,565,876 | B2 | 7/2009 | Wilson et al. |
| 7,765,946 | B1 | 8/2010 | Berman et al. |
| 7,867,046 | B1 | 1/2011 | Eichinger |
| 7,938,377 | B2 | 5/2011 | Dragici et al. |
| 7,942,711 | B1 | 5/2011 | Swan |
| 8,011,982 | B1 | 9/2011 | Baier et al. |
| 8,113,892 | B1 | 2/2012 | Gable et al. |
| 8,261,682 | B1 | 9/2012 | DeVito |
| 8,622,777 | B1 | 1/2014 | McNalley et al. |
| 8,657,638 | B1 | 2/2014 | Gonring |
| 8,818,587 | B1 | 8/2014 | Arbuckle et al. |
| 9,278,740 | B1 | 3/2016 | Andrasko et al. |
| 9,290,252 | B1 | 3/2016 | Tuchscherer et al. |
| 9,296,455 | B2 | 3/2016 | Bernloehr et al. |
| 9,334,034 | B1 | 5/2016 | Waldvogel et al. |
| 9,359,057 | B1 | 6/2016 | Andrasko et al. |
| 9,381,989 | B1 | 7/2016 | Poirier |
| 9,481,439 | B1 | 11/2016 | Groschel et al. |
| 9,517,825 | B1 | 12/2016 | Anschuetz et al. |
| 9,598,160 | B2 | 3/2017 | Andrasko et al. |
| 9,623,948 | B1 | 4/2017 | Waldvogel et al. |
| 9,643,698 | B1 | 5/2017 | Andrasko et al. |
| 9,682,760 | B1 | 6/2017 | O'Brien et al. |
| 9,694,892 | B1 | 7/2017 | Anschuetz et al. |
| 9,701,383 | B1 | 7/2017 | Stuber et al. |
| 9,701,384 | B1 | 7/2017 | Belter |
| 9,738,364 | B2 | 8/2017 | Abney |
| 9,745,036 | B2 | 8/2017 | Andrasko et al. |
| 9,751,605 | B1 | 9/2017 | Anschuetz et al. |
| 9,764,810 | B1 | 9/2017 | Andrasko et al. |
| 9,771,137 | B1 | 9/2017 | Gable et al. |
| 9,776,699 | B1 | 10/2017 | Alby et al. |
| 9,802,688 | B1 | 10/2017 | Tuchscherer et al. |
| D804,431 | S | 12/2017 | Abellera et al. |
| 9,857,794 | B1 | 1/2018 | Jarrell et al. |
| 9,862,471 | B1 | 1/2018 | Taylor et al. |
| 9,896,174 | B1 | 2/2018 | Anschuetz |
| 9,919,781 | B1 | 3/2018 | Andrasko et al. |
| 9,937,984 | B2 | 4/2018 | Herrington et al. |
| 9,944,375 | B1 | 4/2018 | Martin et al. |
| 9,969,475 | B1 | 5/2018 | Waisanen |
| 10,000,267 | B1 | 6/2018 | Anschuetz |
| 10,011,339 | B2 | 7/2018 | Anschuetz |
| 10,054,956 | B1 | 8/2018 | Anschuetz et al. |
| 10,059,415 | B1 | 8/2018 | Anschuetz et al. |
| 10,094,321 | B1 | 10/2018 | Anschuetz et al. |
| 10,112,692 | B1 | 10/2018 | Anschuetz |
| 10,118,681 | B1 | 11/2018 | Andrasko et al. |
| 10,118,682 | B2 | 11/2018 | Anschuetz |
| 10,137,971 | B2 | 11/2018 | Andrasko et al. |
| 10,167,069 | B2 | 1/2019 | Houle et al. |
| 10,214,271 | B1 | 2/2019 | Gonring et al. |
| 10,214,273 | B1 | 2/2019 | Smith et al. |
| 10,227,108 | B2 | 3/2019 | Bostwick |
| 10,281,928 | B2 | 5/2019 | Behling et al. |
| 10,336,429 | B1 | 7/2019 | Amerling et al. |
| 10,351,221 | B1 | 7/2019 | Anschuetz et al. |
| 10,435,127 | B2 | 10/2019 | Suzuki et al. |
| 10,472,038 | B1 | 11/2019 | Walgren et al. |
| 10,494,967 | B1 | 12/2019 | Osthelder et al. |
| 10,518,856 | B2 | 12/2019 | Andrasko et al. |
| 10,518,858 | B1 | 12/2019 | Klawitter et al. |
| 10,577,068 | B1 | 3/2020 | Gonring et al. |
| 10,611,451 | B1 | 4/2020 | Andrasko et al. |
| 10,829,190 | B1 | 11/2020 | Pugh et al. |
| 10,981,637 | B1 | 4/2021 | Alby et al. |
| 11,046,407 | B2 | 6/2021 | Van Dyke |
| 11,072,408 | B1 | 7/2021 | Kurzynski et al. |
| 11,084,563 | B1 | 8/2021 | Pielow et al. |
| 11,097,824 | B1 | 8/2021 | Anderson |
| 11,572,146 | B2 | 2/2023 | Kraus et al. |
| 2008/0173227 | A1 | 7/2008 | Salmon |
| 2010/0136857 | A1 | 6/2010 | Goudsmit |
| 2014/0329422 | A1* | 11/2014 | Ito ..... B63H 5/08 440/1 |
| 2018/0050781 | A1 | 2/2018 | Anschuetz |
| 2018/0335788 | A1* | 11/2018 | Behling ..... B63H 20/10 |
| 2019/0344869 | A1 | 11/2019 | Chan et al. |
| 2021/0200244 | A1 | 7/2021 | Karnick et al. |
| 2021/0237834 | A1 | 8/2021 | They |
| 2022/0266972 | A1 | 8/2022 | Novak et al. |

FOREIGN PATENT DOCUMENTS

| | | | |
|---|---|---|---|
| EP | 2242678 | B1 | 11/2015 |
| EP | 2246252 | B1 | 5/2019 |

OTHER PUBLICATIONS

Lewmar, "Swing Thruster," Product and Installation Manual, 2013, Issue 1.

Sideshift, "Houseboat Thrusters," web page, last visited Feb. 11, 2020, available at https://sideshift.com/products/houseboat-thrusters/.

Dockstar, "Smart Thruster," Operations Manual, 2018, available at https://ff73590a-69f6-41f4-aeea-2c36215fc9e4.filesusr.com/ugd/d51fcc_bc562379e09d4841ae170997f737cd97.pdf.

Gable et al., "Marine Vessels Having a First Marine Drive and a Second Marine Drive and Methods for Controlling Them," U.S. Appl. No. 18/315,323, filed May 10, 2023 (drawings, specification, and claims only).

Perdomo Tornbaum, "Methods for a Marine Vessel with Primary and Auxiliary Propulsion Devices," U.S. Appl. No. 16/984,617, filed Aug. 4, 2020 (drawings, specification, and claims only).

* cited by examiner

METHODS FOR A MARINE VESSEL WITH PRIMARY AND AUXILIARY PROPULSION DEVICES

CROSS-REFERENCE TO RELATED APPLICATIONS

The present application is a continuation-in-part of U.S. patent application Ser. No. 16/984,617, filed Aug. 4, 2020, the content of which is incorporated herein by reference in its entirety. The present application is also a continuation-in-part of U.S. patent application Ser. No. 18/315,323, filed May 10, 2023, the content of which is incorporated herein by reference in its entirety.

FIELD

The present disclosure relates to marine vessels with primary and auxiliary propulsion devices, and more specifically to marine vessels with retractable auxiliary propulsion devices.

BACKGROUND

U.S. Pat. No. 6,142,841 discloses a maneuvering control system which utilizes pressurized liquid at three or more positions of a marine vessel in order to selectively create thrust that moves the marine vessel into desired locations and according to chosen movements. A source of pressurized liquid, such as a pump or a jet pump propulsion system, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as desired. A liquid distribution controller is provided which enables a vessel operator to use a joystick to selectively compress and dilate the distribution conduits to orchestrate the streams of water in a manner which will maneuver the marine vessel as desired. Electrical embodiments of the present invention can utilize one or more pairs of impellers to cause fluid to flow through outlet conduits in order to provide thrust on the marine vessel. In one embodiment of the present invention, a cross thrust conduit is associated with a marine vessel to direct fluid flow in a direction perpendicular to a centerline of the marine vessel and a pair of outlet conduits are associated with the marine vessel to direct flows of fluid in directions which are neither parallel nor perpendicular to a centerline of the marine vessel. In this embodiment, reversible motors are used to rotate associated impellers in either forward or reverse directions. In any of the embodiments of the present invention, a joy stick control can be used to select or deselect each of the outlet conduits and, in certain embodiments, to select the direction of operation of an associated reversible motor.

U.S. Pat. No. 7,150,662 discloses an improved docking system for a watercraft and a propulsion assembly therefor wherein the docking system comprises a plurality of the propulsion assemblies and wherein each propulsion assembly includes a motor and propeller assembly provided on the distal end of a steering column and each of the propulsion assemblies is attachable in an operating position such that the motor and propeller assembly thereof will extend into the water and can be turned for steering the watercraft.

U.S. Pat. No. 7,765,946 discloses a system and apparatus for providing integrated boat thrusters which eliminates interfering with the integrity of the hull, and undesirable drilling and cutting of the hull to accommodate separate glass tubes or pipes that are conventionally used to form thruster tunnels. The instant system provides integrally molded thruster tunnel sections within the hull, and unique keystone inserts which are complementary to the molded thruster tunnel sections and complete the water flow chambers through the hull about the propellers. Separate tubes are not utilized. Thruster motors and mounting mechanisms are securely fastened in flat planes enhancing strength, performance and maintenance of the assemblies. In a preferred embodiment, the keystone insert is generally wedge shaped to provide a secure fit and bond within the molded tunnel section having angled walls.

U.S. patent application Ser. No. 18/315,323, filed May 10, 2023, discloses a marine vessel configured to be situated in water. The marine vessel includes a first marine drive and a second marine drive each configured to propel the marine vessel in the water. A first actuator is configured to change a trim angle of the first marine drive in the water. A second actuator is configured to change a depth of the second marine drive in the water. A control system is operatively connected to the first actuator and the second actuator. The control system is configured to change the depth of the second marine drive via the second actuator based on the trim angle of the first marine drive to prevent damage to the second marine drive.

The above patents and patent application are incorporated herein by reference in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to a first example, a method for a marine vessel, which is carried out by a vessel control system, includes determining if a first propulsion device on the marine vessel is rotated about a horizontal tilt/trim axis above a predetermined threshold and determining if a second propulsion device on the marine vessel is deployed. If the second propulsion device is deployed, the method includes retracting the second propulsion device in response to determining that the first propulsion device is rotated above the predetermined threshold. If the second propulsion device is not deployed, the method includes prohibiting the second propulsion device from being deployed in response to determining that the first propulsion device is rotated above the predetermined threshold.

According to another example, a method for a marine vessel, which is carried out by a vessel control system, includes retracting or maintaining a retracted position of an auxiliary propulsion device on the marine vessel in response to a primary propulsion device on the marine vessel being rotated about a horizontal tilt/trim axis above a predetermined threshold and the auxiliary propulsion device being deployed or commanded to deploy, respectively.

According to another example, a method for a marine vessel, which is carried out by a vessel control system, includes determining if a primary propulsion device on the marine vessel is rotated about a horizontal tilt/trim axis above a predetermined threshold and determining if an auxiliary propulsion device on the marine vessel is deployed. In response to determining that the auxiliary propulsion device is deployed and the primary propulsion device is rotated above the predetermined threshold, the method includes doing at least one of the following: retracting the auxiliary propulsion device and/or emitting an alert. In response to determining that the auxiliary propulsion device is not deployed and the primary propulsion device is rotated above the predetermined threshold, the method includes doing at least one of the following: overriding a command to deploy the auxiliary propulsion device and/or emitting the alert.

According to another example, a method for a marine vessel, which is carried out by a vessel control system, comprises: determining if a first propulsion device on the marine vessel is rotated about a horizontal tilt/trim axis above a predetermined threshold; determining if a second propulsion device on the marine vessel is deployed; and if the second propulsion device is deployed, retracting the second propulsion device in response to determining that the first propulsion device is rotated above the predetermined threshold.

According to another example, a method for a marine vessel, which is carried out by a vessel control system, comprises: determining if a first propulsion device on the marine vessel is rotated about a horizontal tilt/trim axis above a predetermined threshold; determining if a second propulsion device on the marine vessel is deployed; and if the second propulsion device is not deployed, prohibiting the second propulsion device from being deployed in response to determining that the first propulsion device is rotated above the predetermined threshold.

According to another example, a method for a marine vessel, which is carried out by a vessel control system, comprises: determining if a primary propulsion device on the marine vessel is rotated about a horizontal tilt/trim axis above a predetermined threshold; determining if an auxiliary propulsion device on the marine vessel is deployed; retracting the auxiliary propulsion device in response to determining that the auxiliary propulsion device is deployed and the primary propulsion device is rotated above the predetermined threshold; and overriding a command to deploy the auxiliary propulsion device in response to determining that the auxiliary propulsion device is not deployed and the primary propulsion device is rotated above the predetermined threshold.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
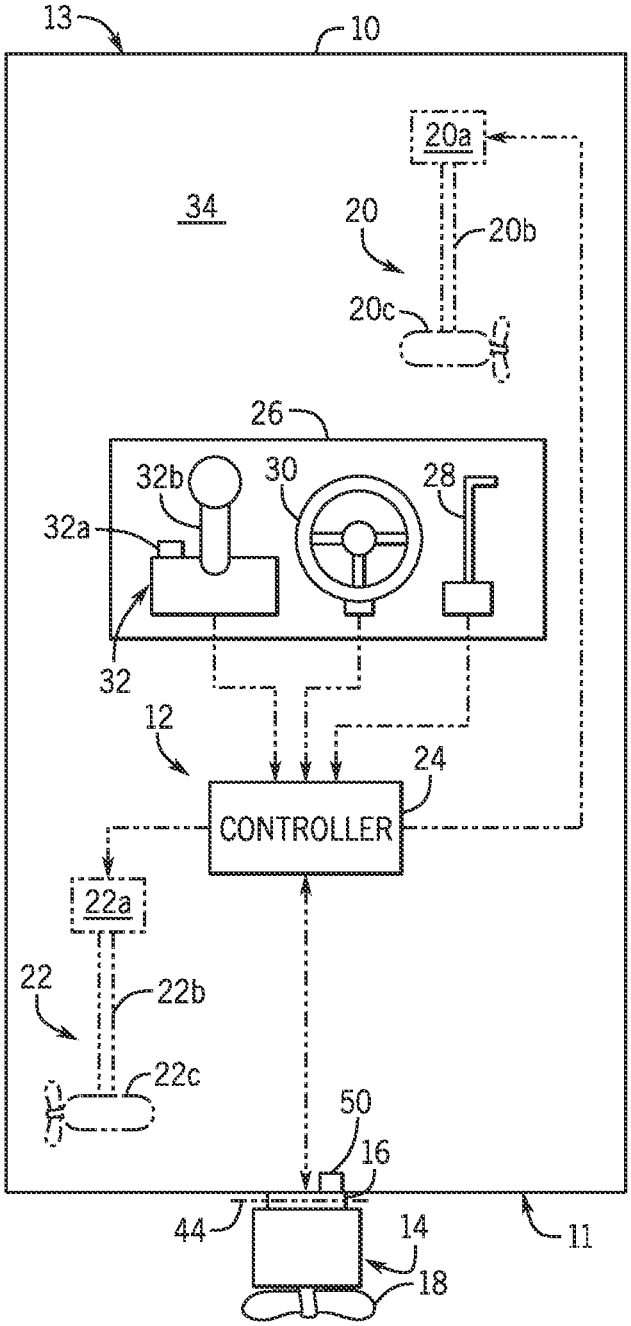
FIG. 1 is a schematic view of a marine vessel having a primary propulsion device, two auxiliary propulsion devices, and a vessel control system in communication therewith.

FIG. 1 illustrates a marine vessel 10 including a vessel control system 12. An engine-powered primary propulsion device 14 is coupled to a stern 11 of the marine vessel 10 by way of a mounting bracket 16, which includes a tilt/trim mechanism for rotating the primary propulsion device 14 about a horizontal tilt/trim axis 44, as is known. In the example shown herein, the primary propulsion device 14 is an outboard engine having a propeller 18 that rotates to produce thrust to propel the marine vessel 10 through water; however, the primary propulsion device 14 could instead be a stern drive, an outboard jet drive, or any other tilt/trimmable marine propulsion device, whether steerable or non-steerable. Additionally, as is known, more than one engine-powered primary propulsion device could be provided on the marine vessel 10.

The marine vessel 10 also includes two auxiliary (usually non-engine-powered) propulsion devices 20, 22 near the bow 13 and stern 11 of the marine vessel 10, respectively. In the present example, each auxiliary propulsion device 20, 22 is a retractable thruster and is shown in phantom because it is coupled to an underside of the marine vessel 10 as will be described further herein below. Each auxiliary propulsion device 20, 22 includes an actuator 20*a*, 22*a*, coupled to a shaft 20*b*, 22*b*, which is in turn coupled to a thrust unit 20*c*, 22*c* including a propeller. A motor is provided inside each thrust unit 20*c*, 22*c* to power the propeller thereof. In other examples, an auxiliary propulsion device is provided only at the bow 13 or only at the stern 11 of the marine vessel 10. In still other examples, multiple auxiliary propulsion devices are provided at the bow 13 and/or stern 11, and/or thrusters are provided elsewhere on the marine vessel 10.

The exact configuration of the retractable auxiliary propulsion devices 20, 22 is not limiting on the scope of the present disclosure. As is known to those having ordinary skill in the art, bow and stern thrusters can be externally mounted and movable away from and back towards the hull of the marine vessel 10, or internally mounted and extendable out of and retractable into the hull. The auxiliary propulsion devices 20, 22 can be steerable so as to vary a direction of thrust of the respective thrust units 20*c*, 22*c*, or can be rotationally fixed in place. The auxiliary propulsion devices 20, 22 can be conventional propeller or impeller thrusters, water jet thrusters, or trolling-motor-like thrusters as shown and described herein. In some examples, the auxiliary propulsion devices 20, 22 can produce thrust in two different directions, such as by varying the direction of rotation of their propellers or impellers or the direction of water discharged through their nozzles. The auxiliary propulsion devices 20, 22 can each be powered by an electric source such as a battery or a solar panel connected to an electric motor or to a hydraulic pump-motor system. For example, if each auxiliary propulsion device's power source is an electric motor, each auxiliary propulsion device 20, 22 may include an output shaft, gear set, transmission, or motor armature inside a housing with magnets that rotates a propeller or impeller shaft or the pump shaft of a water pump. The above-described types of thrusters are well known in the art and therefore will not be described further herein.

Still referring to FIG. 1, the vessel control system 12 includes a controller 24 in signal communication with the primary propulsion device 14 and the auxiliary propulsion devices 20, 22. The controller 24 is programmable and includes a processor and a memory. The controller 24 can be located anywhere on the marine vessel 10 and can communicate with various components of the marine vessel 10 via a peripheral interface and wired and/or wireless links, as will be explained further herein below. Although FIG. 1 shows one controller 24, the vessel control system 12 can include more than one controller. Portions of the methods disclosed herein below can be carried out by a single controller or by several separate controllers. For example, the vessel control system 12 can have controllers located at or near a control console 26 of the marine vessel 10 and can also have controllers located at or near the primary propulsion device 14 and/or the auxiliary propulsion devices 20, 22. If more than one controller is provided, each can control operation of a specific device or sub-system on the marine vessel 10.

In some examples, the controller 24 may include a computing system that includes a processing system, storage system, software, and input/output interfaces for communicating with peripheral devices. The systems may be implemented in hardware and/or software that carries out a programmed set of instructions. For example, the processing system loads and executes software from the storage system, which software directs the processing system to operate as described herein below in further detail. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer executable instructions for carrying out various functions as described herein.

The storage system can comprise any storage media readable by the processing system and capable of storing software. The storage system can include volatile and non-volatile, removable and non-removable media implemented in any method or technology for storage of information, such as computer-readable instructions, data structures, software program modules, or other data. The storage system can be implemented as a single storage device or across multiple storage devices or sub-systems. The storage system can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The controller 24 communicates with one or more components on the marine vessel 10 via the I/O interfaces and a communication link, which can be a wired or wireless link. The controller 24 is capable of monitoring and controlling one or more operational characteristics of the various systems and subsystems onboard the marine vessel 10 by sending and receiving control signals via the communication link. In one example, the communication link is a controller area network (CAN) bus, but other types of links could be used. It should be noted that the extent of connections of the communication link shown herein is for schematic purposes only, and the communication link in fact provides communication between the controller 24 and each of the peripheral devices in the vessel control system 12 noted herein, although not every connection is shown in the drawing for purposes of clarity.

The control console 26 includes a number of user-operated input devices in signal communication with the controller 24. For instance, the control console 26 includes a shift/throttle lever 28 for inputting gear and speed commands to the controller 24, which then commands the primary propulsion device 14 to shift to forward, neutral, or reverse and to position the throttle of the engine accordingly, as is known. A steering wheel 30 is provided for inputting directional steering commands to the controller 24, which the controller 24 outputs to a steering actuator that controls a steered position of the primary propulsion device 14. The control console 26 also includes a joystick 32 that is tiltable and rotatable to provide vessel movement commands to the controller 24. In order to enable a joysticking mode of the vessel control system 12, it may be required that an operator first manipulate a user input device, such as a button 32*a* located on the base of the joystick 32. Furthermore, in some examples, it may also be required that the engine of the primary propulsion device 14 is on and running and that the shift/throttle lever 28 is in neutral before the joysticking mode can be enabled via the button 32*a*. Note that there are other ways to enable the joysticking mode, however, and the above examples are not limiting on the scope of the present disclosure.

In a non-joysticking mode, an operator is able to maneuver the marine vessel 10 generally forwards or backwards by commanding the primary propulsion device 14 to forward or reverse gear using the shift/throttle lever 28. The operator may further maneuver the marine vessel 10 at an angle to one side or the other using the steering wheel 30 while traveling forwards or backwards under the power of the primary propulsion device 14. However, on vessels equipped with only one primary propulsion device 14, it is very difficult, if not impossible, to maneuver the marine vessel 10 directly side-to-side (lateral translation) or in a tight radius, which are maneuvers typically requested while operating in a joysticking mode. By providing auxiliary propulsion devices 20, 22, the marine vessel 10 is able to accomplish such "joysticking maneuvers," as more than one source of thrust at more than one location is provided to move the vessel 10. For example, in the joysticking mode, under the power of the auxiliary propulsion devices 20, 22, the handle 32*b* of the joystick 32 can be tilted away from its resting vertical orientation in order to request movement of the vessel 10 in any of a forward, reverse, starboard, port and/or combined (e.g., diagonal) direction. Additionally, the handle 32*b* or knob of the joystick 32 can be rotated about the handle axis in order to request rotation (yaw) of the vessel 10. As known to those having ordinary skill in the art, the handle 32*b* of the joystick 32 can be rotated at the same time that it is tilted in order to request both rotation and translation of the vessel 10 at the same time. The controller 24 interprets these inputs from the joystick 32 and outputs commands to the auxiliary propulsion devices 20, 22 to cause them to turn on or off, increase or decrease propeller speed, rotate about steering axes, and/or change directions (forward or reverse) accordingly so as to achieve the commanded maneuvers. The algorithms that the controller 24 can use to translate inputs from the joystick 32 to outputs to the auxiliary propulsion devices 20, 22 are well known in the art and therefore will not be discussed further herein.

Figure 2:
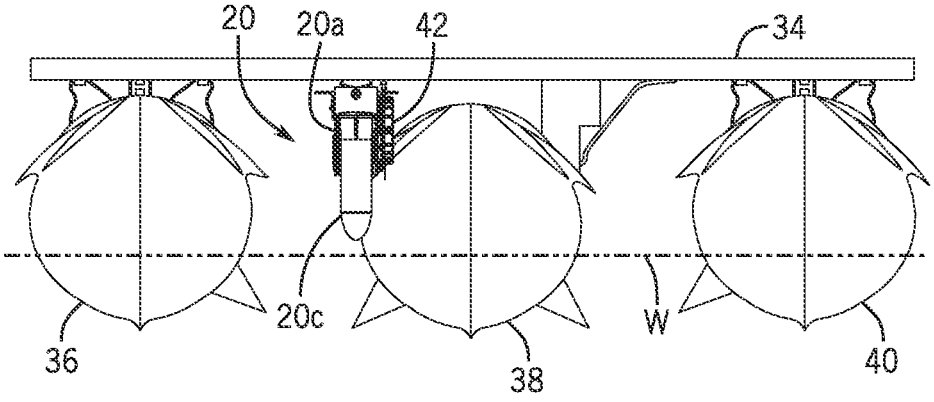
FIG. 2 is a front elevation view of a portion of a marine vessel, such as a pontoon boat, equipped with an auxiliary propulsion device in a retracted position.

FIG. 2 is a front elevation view of a portion of the marine vessel 10. In this example, the marine vessel 10 is a pontoon boat having a deck 34 with three pontoons 36, 38, 40 coupled to the underside thereof. While the auxiliary propulsion device 22 at the stern 11 of the marine vessel 10 cannot be seen, as it is located behind the pontoon 40, the auxiliary propulsion device 20 at the bow 13 of the marine vessel 10 is shown between the pontoons 36 and 38. Although the auxiliary propulsion device 22 will not be described further herein, it can be designed and operate in the same manner as the auxiliary propulsion device 20 described herein below. It can be seen that the auxiliary propulsion device 20 is coupled to the bottom surface of the deck 34 by way of a bracket 42, to which the actuator 20*a* is also attached. In FIG. 2, the auxiliary propulsion device 20 is shown in a retracted position, in which the shaft 20*b* (not shown, but see FIGS. 1, 3) is generally parallel to the deck 34, and the thrust unit 20*c* is stowed next to the bottom surface of the deck 34. In another example, the shaft 20*b* may be retracted to an acute angle with respect to the bottom surface of the deck 34. In still another example, the shaft 20*b* may be a telescoping shaft, which remains perpendicular to the bottom surface of the deck 34 when retracted. The bracket 42 and auxiliary propulsion device 20 can be designed such that in the retracted position, the thrust unit 20*c* (and indeed, the entire auxiliary propulsion device 20) is above the water level W.

Figure 3:
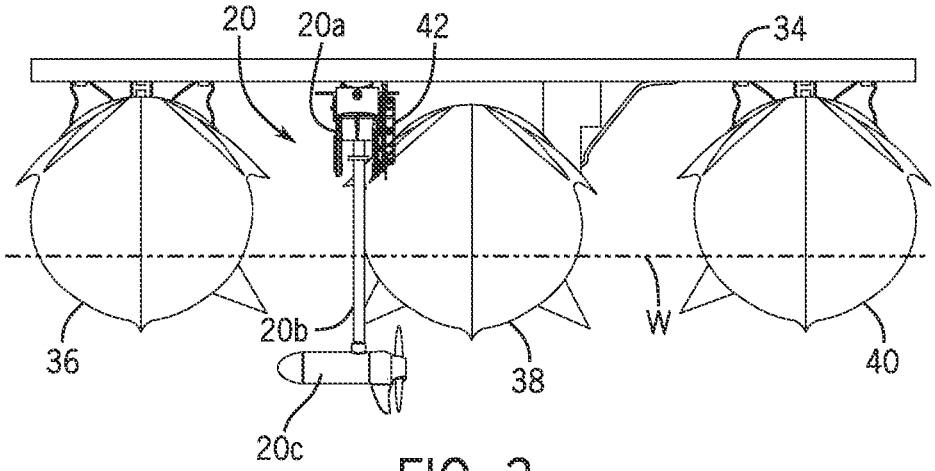
FIG. 3 is a front elevation view of the portion of the pontoon boat with the auxiliary propulsion device in a deployed position.

In contrast, in FIG. 3, the auxiliary propulsion device 20 is in a deployed position, in which the shaft 20*b* is generally perpendicular to the deck 34 and the thrust unit 20*c* is further from the deck 34 than when the auxiliary propulsion device 20 is in the retracted position. The bracket 42 and auxiliary propulsion device 20 can be designed such that in the deployed position, the thrust unit 20*c* is below the water level W, and thus able to produce thrust to maneuver the marine vessel 10 in the water. In the present example, in which the auxiliary propulsion device 20 is provided on a pontoon boat, the deployed depth of the thrust unit 20*c* below the deck 34 can be specifically designed to be below the bottom surfaces of the pontoons 36, 38, 40, so that the pontoons 36, 38, 40 do not interfere with the thrust generated by the thrust unit 20*c* and the propeller is not spinning in air.

In order to move the auxiliary propulsion device 20 from the retracted position of FIG. 2 to the deployed position of FIG. 3, the controller 24 activates the electric or hydraulic actuator 20*a* to lower the thrust unit 20*c* of the auxiliary propulsion device 20 by pivoting the shaft 20*b* about an axis along which the opposite end of the shaft 20*b* is coupled to the bracket 42. The actuator 20*a* could be a hydraulic piston/cylinder, an electric linear actuator, an electric rotary actuator, an electric motor coupled to a gear set or a rack-and-pinion device, or any other actuator suitable for use in a marine environment. Portions of the actuator 20*a* for retracting and deploying the auxiliary propulsion device 20 could be used to steer the thrust unit 20*c* in the event that the auxiliary propulsion device 20 is steerable, or a separate steering actuator could be provided.

Figure 4:
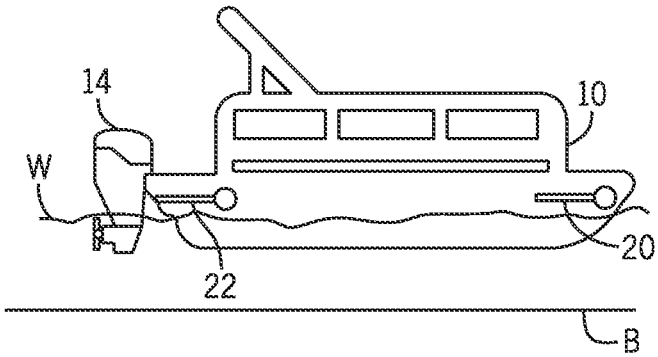
FIG. 4 is a schematic showing a marine vessel with a primary propulsion device and an auxiliary propulsion device operating in deep water with the auxiliary propulsion device retracted.
Figure 5:
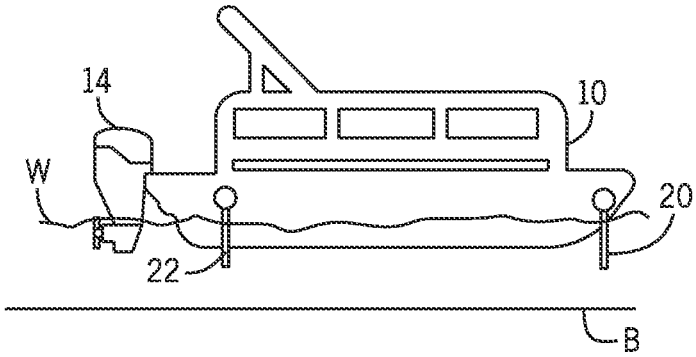
FIG. 5 is a schematic showing the marine vessel with the primary propulsion device and the auxiliary propulsion device operating in deep water with the auxiliary propulsion device deployed.
Figure 6:
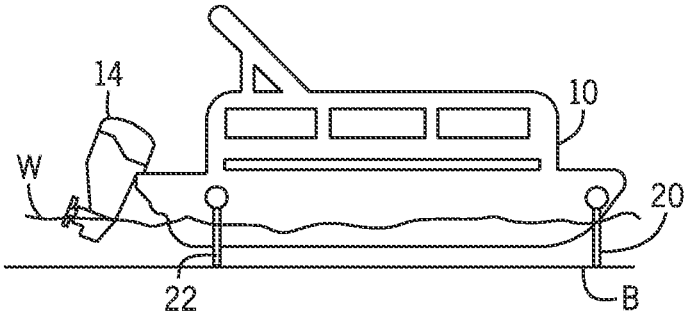
FIG. 6 is a schematic showing the marine vessel with the primary propulsion device and the auxiliary propulsion device operating in shallow water with the auxiliary propulsion device deployed.

Generally, a pontoon boat will benefit from provision of the retractable auxiliary propulsion devices 20, 22 because the pontoons 36, 38, 40 raise the deck 34 of the marine vessel 10 out of the water while providing room between the deck 34 and the water level W within which the retracted auxiliary propulsion devices 20, 22 can be stowed. As shown in FIG. 4, when the operator is using the primary propulsion device 14 to maneuver the marine vessel 10, the auxiliary propulsion devices 20, 22 remain out of the water and therefore do not create extra drag, nor are they able to be damaged by debris in the water. However, as shown in FIG. 5, when the operator wants to accomplish more precise maneuvers than those available with a single primary propulsion device 14, the operator is able to deploy the auxiliary propulsion devices 20, 22 in order to operate in the joysticking mode. As long as the water level W is deep enough, the auxiliary propulsion devices 20, 22 will not hit the bottom B of the waterbed. However, as shown in FIG. 6, if the water level W is shallow, and the operator deploys the auxiliary propulsion devices 20, 22, the auxiliary propulsion devices 20, 22 may hit the bottom B of the waterbed, thus damaging the auxiliary propulsion devices 20, 22. Furthermore, the deployed depth of the auxiliary propulsion devices 20, 22 described with respect to FIG. 3 makes them susceptible to damage because the auxiliary propulsion devices 20, 22 would run aground before the pontoons 36, 38, 40.

Through research and development, the present inventors have recognized that most experienced marine vessel operators are accustomed to trimming a primary propulsion device 14 on a marine vessel 10 up when they enter shallow water. For example, the primary propulsion device 14 in FIG. 6 is shown as being rotated by the trim actuator on the mounting bracket 16 about a horizontal tilt/trim axis (see 44, FIG. 1) to a position that is at a greater angle with respect to vertical than the angle of the primary propulsion device 14 with respect to vertical in FIGS. 4 and 5. Thus, the present inventors discovered that linking the position of the auxiliary propulsion devices 20, 22 to that of the primary propulsion device 14 could prevent damage to the auxiliary propulsion devices 20, 22 when the marine vessel 10 enters shallow water. Thus, operators who are not as familiar with newer retractable-thruster-equipped vessels can enjoy the benefits of joysticking mode without the risk that they will run their thrusters aground, which could potentially cause damage.

Figure 7:
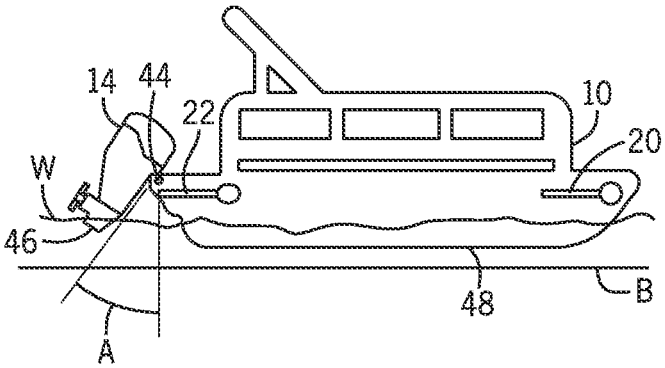
FIG. 7 is a schematic showing the marine vessel with the primary propulsion device and the auxiliary propulsion device operating in shallow water with the auxiliary propulsion device retracted.

Thus, as shown in FIG. 7, the present inventors developed a method for a marine vessel 10 that is carried out by a vessel control system 12 and comprises retracting or maintaining a retracted position of an auxiliary propulsion device 20, 22 on a marine vessel 10 in response to a primary propulsion device 14 on the marine vessel 10 being rotated about a horizontal tilt/trim axis 44 above a predetermined threshold and the auxiliary propulsion device 20, 22 being deployed or commanded to deploy, respectively. In other words, the vessel control system 12 will retract the auxiliary propulsion devices 20, 22 in response to the primary propulsion device 14 on the marine vessel 10 being rotated about the horizontal tilt/trim axis 44 above the predetermined threshold and the auxiliary propulsion devices 20, 22 being in a deployed state. The vessel control system 12 will maintain the retracted position of the auxiliary propulsion devices 20, 22 in response to the primary propulsion device 14 being rotated about the horizontal tilt/trim axis 44 above the predetermined threshold and the auxiliary propulsion devices 20, 22 being commanded to deploy from the retracted state. In this way, the auxiliary propulsion devices 20, 22 will be placed or maintained in the retracted position, as shown, when the primary propulsion device 14 is tilted or trimmed above the predetermined threshold.

In FIG. 7, the predetermined threshold is the angle A from vertical, but the predetermined threshold could be other than that shown herein and/or could be measured in a different manner. In one example, as shown herein, the predetermined threshold A is a rotational position about the tilt/trim axis 44 at which a skeg 46 on the primary propulsion device 14 is level with a keel 48 of the marine vessel 10. In another example, the predetermined threshold is a rotational position about the tilt/trim axis 44 commonly referred to as the "trailering" position, in which the primary propulsion device 14 is rotated to its maximum height for trailering of the marine vessel 10. In yet another example, the predetermined threshold is a rotational position about the tilt/trim axis 44 at which the trim actuator on the mounting bracket 16 can no longer rotate the primary propulsion device 14 up, and the tilt actuator (if provided) takes over to accomplish further upward rotation. Note that although the predetermined threshold has been described herein as an angle or a rotational position, the position may be expressed as a percentage, such as a percentage of full trim or full tilt capabilities of the trim and/or tilt actuator(s). The threshold may be defined with respect to vertical, as shown in FIG. 7, or the threshold may be defined with respect to a fully-down trim position, which may be a position in which the lower unit of the primary propulsion device 14 is tucked under. Other ways to define the threshold, which may be stored in the memory of the controller 24 by a manufacturer, installer, or operator, could be used within the scope of the present disclosure.

Figure 8:
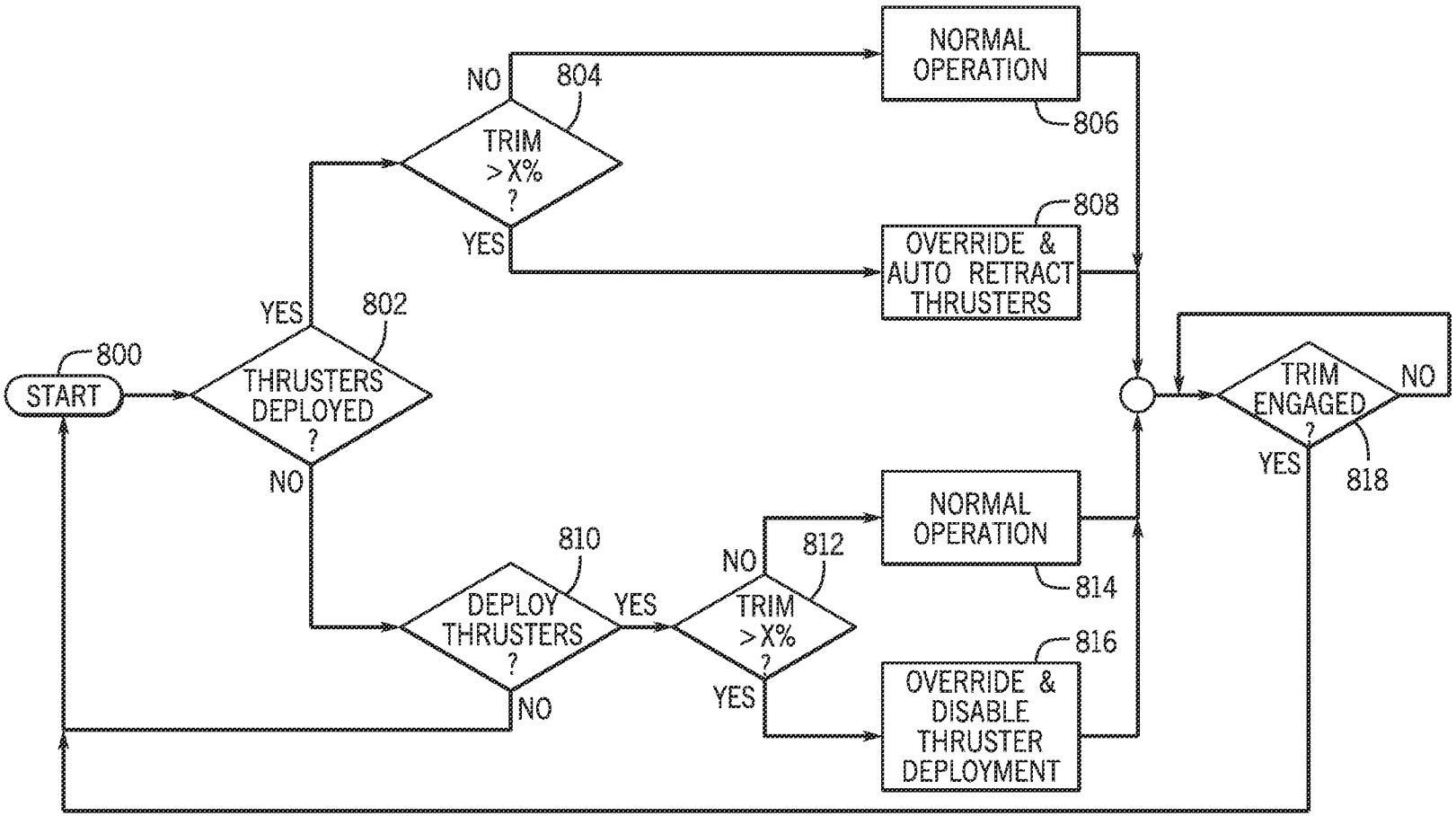
FIG. 8 is a diagram showing exemplary logic a controller of a vessel control system could use to determine whether to retract or deploy an auxiliary propulsion device.

FIG. 8 illustrates logic that that controller 24 may use to carry out the methods of the present disclosure. The logic begins at START at 800. The vessel control system 12 determines if the thrusters are deployed at 802. The vessel control system 12 may make this determination based on readings from sensors (such as Hall effect sensors or potentiometers, depending on the type of actuator 20*a*, 22*a*) located on or near each of the auxiliary propulsion devices 20, 22, or may make the determination based on the controller 24 retrieving the last command to the actuators 20*a*, 22*a*. For example, if the controller 24 determines that it last commanded the actuators 20*a*, 22*a* to deploy the auxiliary propulsion devices, the controller 24 may determine that the auxiliary propulsion devices 20, 22 are still deployed. If the thrusters are deployed (YES at 802), the vessel control system 12 then determines if the primary propulsion device's trim is greater than a predetermined threshold (here, x %), as shown at 804. The vessel control system 12 can make this determination based on a reading from a trim sensor 50 (FIG. 1) associated with the primary propulsion device 14, such as a Hall effect sensor sensing the extension of one portion of the trim actuator with respect to another portion, after which the controller 24 can compare the sensed value to the predetermined threshold stored in its memory. If the trim is not greater than the predetermined threshold, the vessel control system 12 operates normally as shown at 806, and all components remain as-is. If, on the other hand, the trim is greater than the predetermined threshold (YES at 804), the vessel control system 12 automatically retracts the auxiliary propulsion devices 20, 22, as shown at 808.

Returning to 802, if the thrusters are not yet deployed, the vessel control system 12 next determines if a command is input to deploy the thrusters, as shown at 810. For example, the controller 24 may receive the command to deploy the auxiliary propulsion devices 20, 21 from a user input device. In one example, the user input device is the button 32*a* on the joystick 32. In another example, the user input device may be a soft key on a touchscreen or a tactile button provided elsewhere at the control console 26. In still other examples, the user input device is a handheld remote control device, such as a dedicated remote control or a smart device in communication with the controller 24. In still other examples, no extra step is required to deploy the thrusters, and the moment that the joysticking mode is enabled, the controller 24 commands the actuators 20*a*, 22*a* to deploy the auxiliary propulsion devices 20, 22.

If the thrusters are not commanded to deploy (NO at 810), the logic returns to START at 800. If the thrusters are commanded to deploy (YES at 810), the logic continues to 812, where the vessel control system 12 determines if the primary propulsion device's trim is greater than the predetermined threshold. Again, this is done by the controller 24 comparing a predetermined value in its memory to a value sensed by the trim sensor 50. If NO at 812, the vessel control system 12 resumes normal operation, as shown at 814. In other words, the vessel control system 12 deploys the auxiliary propulsion devices 20, 22 in response to the command to deploy the auxiliary propulsion devices 20, 22 if the primary propulsion device 14 is rotated below the predetermined threshold (e.g., x %).

However, if YES at 812, the vessel control system 12 overrides the operator's command to deploy the thrusters and prohibits the auxiliary propulsion devices 20, 22 from being deployed as shown at 816. Because the vessel control system 12 is overriding an operator command, the vessel control system 12 may also generate an alert in response to the command to deploy the auxiliary propulsion devices 20, 22 at 810 if the primary propulsion device 14 is determined to be rotated above the predetermined threshold at 812. For example, the joystick 32 may have lights that flash a different color or may have a screen that generates a written message that the water is too shallow for the thrusters to be deployed. Additionally or alternatively, the alert could be an audible alert via a speaker or a haptic alert (e.g., vibration) via the handle 32*b* of the joystick 32.

Whether at 806, 808, 814, or 816, the controller 24 next determines if the trim system for the primary propulsion device 14 has been engaged, as shown at 818. For example, the vessel control system 12 may determine that the operator has input a "trim up" command or a "trim down" command at the control console 26. If the trim system is not engaged, the logic waits until the trim system is engaged. Once the trim system is engaged (YES at 818), the logic returns to START at 800, and the vessel control system 12 determines if the change in trim position of the primary propulsion device 14 means that the auxiliary propulsion devices 20, 22 need to be retracted (if deployed) or prevented from deploying (if commanded to deploy). Thus, the vessel control system 12 determines if the auxiliary propulsion devices 20, 22 are deployed in response to receiving a command to change a rotational position of the primary propulsion device 14 about the tilt/trim axis 44.

Figure 9:
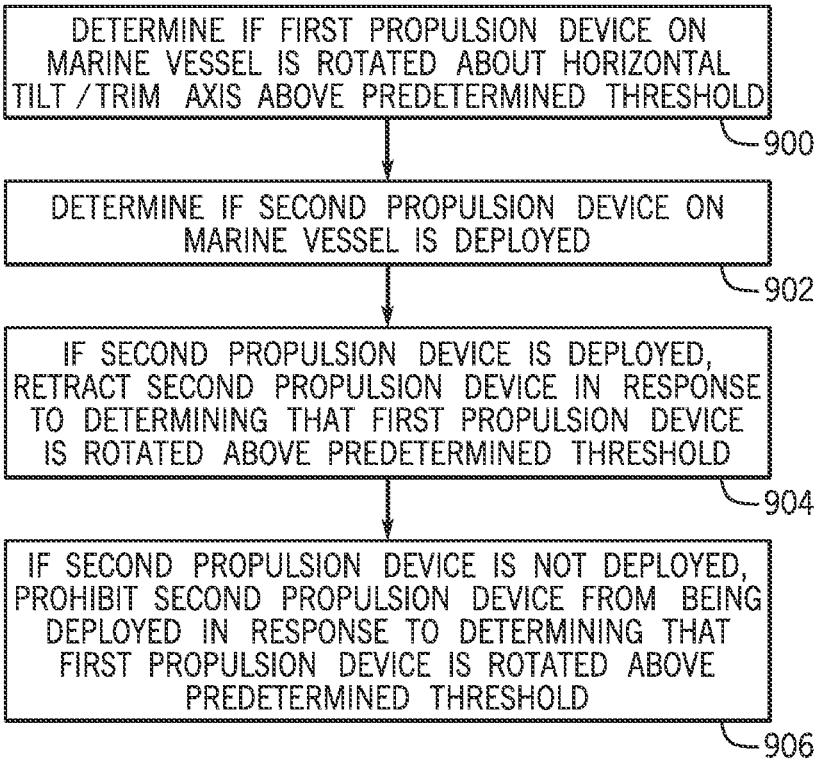
FIG. 9 depicts a method according to the present disclosure.

Thus, referring to FIG. 9, a method for a marine vessel 10 is disclosed. The method is carried out by a vessel control system 12 and comprises determining if a first propulsion device (e.g., primary propulsion device 14) on the marine vessel 10 is rotated about a horizontal tilt/trim axis 44 above a predetermined threshold, as shown at 900. The method also comprises determining if a second propulsion device (e.g., auxiliary propulsion devices 20 and/or 22) on the marine vessel 10 is deployed, as shown at 902. Generally, the two auxiliary propulsion devices 20 and 22 will be deployed or retracted together, so determining if one of the two is deployed or retracted will tell the position of the other. If the second propulsion devices 20 and/or 22 is/are deployed, the method includes retracting the second propulsion devices 20, 22 in response to determining that the first propulsion device 14 is rotated above the predetermined threshold, as shown at 904. If the second propulsion devices 20 and/or 22 is/are not deployed, the method includes prohibiting the second propulsion devices 20, 22 from being deployed in response to determining that the first propulsion device 14 is rotated above the predetermined threshold, as shown at 906.

As described herein above with respect to FIGS. 2 and 3, retracting the second propulsion device comprises moving a thrust-producing portion (e.g., thrust unit 20*c*, 22*c*) of the second propulsion device closer to a hull (e.g., deck 34) of the marine vessel 10. Correspondingly, deploying the second propulsion device comprises moving the thrust-producing portion (e.g., thrust unit 20*c*, 22*c*) of the second propulsion device further from the hull. While a trolling-motor-like thruster was described with respect to the present disclosure, other thrusters as described herein could be controlled according to the same method. Non-limiting examples of thrusters that could be used as the auxiliary propulsion devices 20, 22 include those provided by SideShift of Ontario, Canada; Lewmar of Guilford, Connecticut; or Max Power of Monza, Italy.

Note that although the first/primary propulsion device 14 was described as being an outboard engine or a stern drive, and the second/auxiliary propulsion devices 20, 22 were described as being as thrusters, other types of propulsion devices could be used according to the type of vessel and the requirements of the conditions in which the vessel is to operate. More generally, the first propulsion device is a primary propulsion device configured to produce power up to a given first threshold, and the second propulsion device is an auxiliary propulsion device configured to produce power up to a given second threshold that is less than the given first threshold. Thus, the first propulsion device is generally larger and used for faster vessel speeds, while the second propulsion device is generally smaller and used for precise maneuvering at slower speeds and/or in close quarters, such as when docking.

Figure 10:
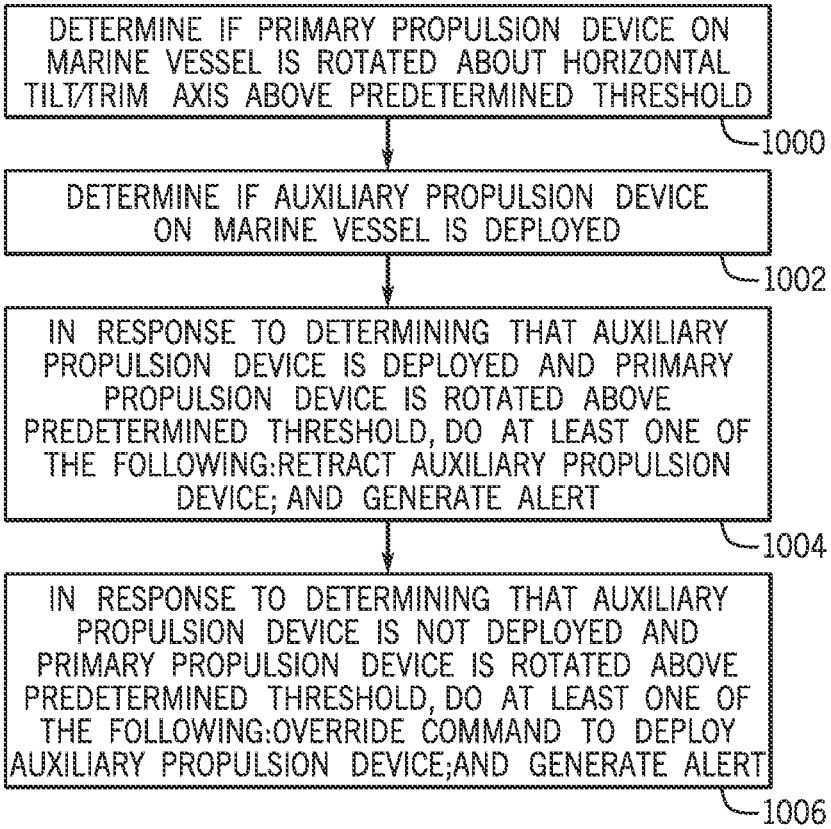
FIG. 10 depicts another method according to the present disclosure.

Furthermore, although the present methods have been described as automatically retracting the auxiliary propulsion devices 20, 22 in response to sensing that they are deployed and the primary propulsion device 14 is rotated up past the threshold, in other examples, the operator is instead merely warned that deploying the thrusters could result in their hitting the bottom of the waterbed, but the thrusters are nonetheless deployed. For example, referring to FIG. 10, another method for a marine vessel 10 is described, the method being carried out by a vessel control system 12. As shown at 1000, the method includes determining if a primary propulsion device 14 on the marine vessel 10 is rotated about a horizontal tilt/trim axis 44 above a predetermined threshold. As shown at 1002, the method includes determining if an auxiliary propulsion device 20 and/or 22 on the marine vessel 10 is deployed. As shown at 1004, in response to determining that the auxiliary propulsion device 20 and/or 22 is deployed and the primary propulsion device 14 is rotated above the predetermined threshold, the method includes doing at least one of the following: retracting the auxiliary propulsion devices 20 and 22 and/or generating an alert. If both actions are taken, then the operator knows that the thrusters have been automatically retracted and the joysticking mode will not be available, as the operator might otherwise be expecting. If only an alert is generated, but the thrusters are not automatically retracted, the operator will at least know that it is possible the thrusters could hit the bottom of the waterbed, and the operator can visually inspect the surroundings of the marine vessel 10 to determine if this is likely. The operator can then choose to override the vessel control system 12, such as by pressing the button 32*a* on the joystick 32 according to a predetermined pattern, or by holding the button 32*a* for a given period of time, in order to dismiss the alert and continue operating in joysticking mode with the primary propulsion device 14 trimmed up above the threshold.

As shown at 1006, in response to determining that the auxiliary propulsion device 20 and/or 22 is not deployed and the primary propulsion device 14 is rotated above the predetermined threshold, the method includes doing at least one of the following: overriding a command to deploy the auxiliary propulsion device 20 and/or 22 and/or generating the alert. According to the first option, as noted herein above, the vessel control system 12 will not act on any command to deploy the auxiliary propulsion devices 20, 22 as long as the primary propulsion device 14 is rotated above the predetermined threshold. The alert may also be provided in order to inform the operator that the joysticking mode will not be available because the thrusters are not deployed. The vessel control system 12 may alternatively carry out the second option alone, such that the vessel control system 12 deploys the auxiliary propulsion devices 20, 22 in response to a command to do so, while also generating an alert, letting the operator know that the auxiliary propulsion devices 20, 22 could be damaged by such deployment. In yet another example, the alert could be followed by a wait time, during which the operator can determine if the operator wants to deploy the auxiliary propulsion devices 20, 22 in spite of the alert. For example, if the wait time passes without the operator taking any action to confirm that the auxiliary propulsion devices 20, 22 should be deployed, the auxiliary propulsion devices 20, 22 may be maintained in the retracted state. If desired, the operator can confirm that the auxiliary propulsion devices 20, 22 are to be deployed by selecting the button 32*a* again or by holding the button 32*a* down for a given period of time.

In another example, the controller 24 is configured to generate an alert when the primary propulsion device 14 is trimmed up to a first predetermined threshold, which is less than a second predetermined threshold at which the vessel control system 12 will automatically retract the auxiliary propulsion devices 20, 22 (if deployed) or prohibit their deployment (if retracted). The first predetermined threshold could be, by way of non-limiting example, 90% of the second predetermined threshold.

In still other examples, if the auxiliary propulsion devices 20, 22 are automatically retracted or are prohibited from being deployed, the controller 24 may be configured to operate the primary propulsion device 14 to carry out limited operating in the joysticking mode in response to the button 32*a* being pressed and the joystick manipulated.

In still other examples, the marine vessel 10 and/or propulsion devices 14, 20, 22 may be equipped with SONAR that can determine the depth of the water in which the marine vessel 10 is operating. The controller 24 can be programmed with the deployed depth of the auxiliary propulsion devices 20, 22, and can compare the water depth to the depth of the auxiliary propulsion devices 20, 22 to determine if they need to be retracted or prohibited from deploying. Similarly, if GPS data is available on the marine vessel 10, as well as bathymetric data, the GPS position of the marine vessel 10 can be compared to known water depths to determine if it is likely the auxiliary propulsion devices 20, 22 will strike the waterbed. The controller 24 may make the comparison to SONAR or GPS-based depth data in response to the primary propulsion device 14 being trimmed above the predetermined threshold and the auxiliary propulsion devices 20, 22 being deployed or commanded to deploy, or the controller 24 may make the comparison only in response to the auxiliary propulsion devices 20, 22 being commanded to deploy.

Figure 11:
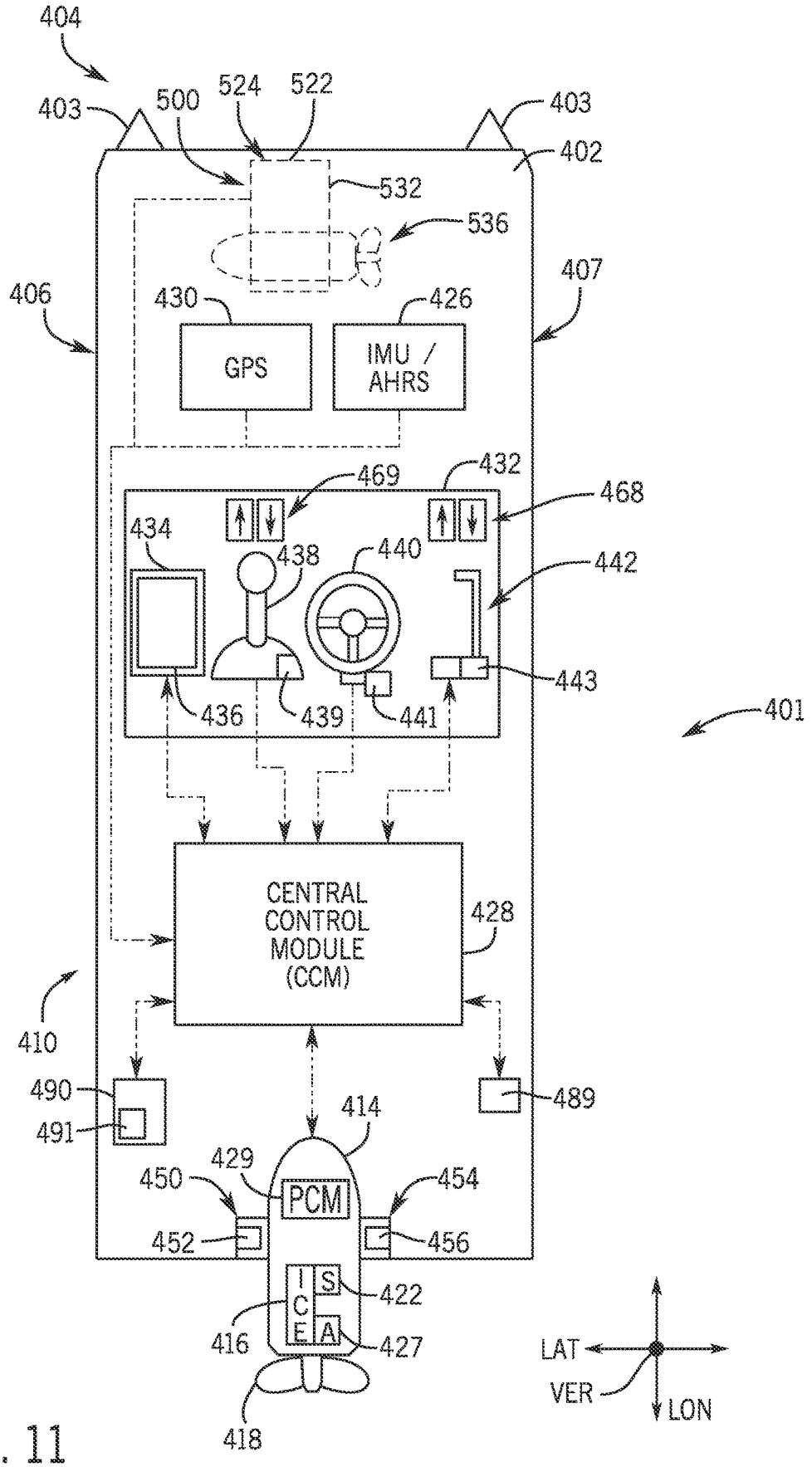
FIG. 11 is a top view of another exemplary marine vessel incorporating the systems and methods of the present disclosure.

FIG. 11 illustrates another embodiment of a system 410 for controlling marine drives, such as a first marine drive 414 and/or a second marine drive 500, each configured to propel a marine vessel 401 in the water in which the marine vessel 401 is situated. The marine vessel 401 is shown as a pontoon boat having a deck 402 supported by two or more pontoons 403 that provide float within the water. The marine vessel 401 extends along a longitudinal axis LON between a bow 404 and a stern 405, along a lateral axis LAT between a port side 406 side and starboard side 407, and along a vertical axis VER, wherein the longitudinal axis LON, the lateral axis LAT, and the vertical axis VER are each perpendicular to each other. For the illustrated marine vessel 401, the first marine drive 414 is an outboard motor positioned near the stern 405 of the marine vessel 401 and the second marine drive 500 is a stowable thruster provided near the bow 404 of the marine vessel 401 (e.g., part of Mercury Marine's Joystick Piloting for Outboards (JPO) system for single-engine pontoons). However, the locations, number, and types of the marine drives provided with the marine vessel 401 may vary from that shown, including having one or more inboard motors, stern drives, pod drives, and/or jet drives, the second marine drive 500 near the stern 405 along with the first marine drive 414, and other alternative combinations. The first marine drive 414 includes a powerhead 416, which may be an internal combustion engine (e.g., gasoline or diesel engine), an electric motor, and/or a hybrid thereof. The first marine drive 414 in the illustrated example also includes a propeller 418 configured to be coupled in torque-transmitting relationship to the powerhead 416. The propeller 418 is rotated about a propeller shaft axis PSA (FIG. 12) to propel the marine vessel 401 in the water in a manner known in the art.

The first marine drive 414 further includes powerhead speed sensor 422 that measures a speed of the respective powerhead 416 or an output shaft thereof. In one example, the powerhead speed sensor 422 is a shaft rotational speed sensor (e.g., a Hall-Effect sensor) that measures a speed of the powerhead 416 in rotations per minute (RPM) in a manner known in the art.

A central control module 428 (or CCM 428) is provided in signal communication with the powerhead 416, as well as being in signal communication with the associated sensors and other components noted herein below. In certain examples, the central control module 428 communicates with a propulsion control module 429 (or PCM 429) and/or other control devices associated with the first marine drive 414 in a manner known in the art. Similar control is also provided for controlling the second marine drive 500, as discussed further below.

Power is provided to the marine vessel 401 via a power system 490, which in certain embodiments includes batteries 491 and/or other energy storage systems known in the art. The power system 490 provides power to the central control module 428 and propulsion control module 429, as well as to other components associated with the first marine drive 414 and the second marine drive 500 or marine vessel 401 more generally. Among the other components powered by the power system 490 is a steering actuator 450 that steers the first marine drive 414 in accordance with commands from a steering device as discussed further below. Exemplary steering actuators 450 are disclosed in U.S. Pat. Nos. 7,150,664; 7,255,616; and 7,467,595, which are incorporated by reference in entirety herein. By way of example, the steering actuator 450 may be a hydraulic actuator, a pneumatic actuator, an electromechanical actuator, or a hybrid thereof.

With continued reference to FIG. 11, the steering actuator 450 illustrated is a "steer-by-wire" system, whereby the steering actuator is controlled by electronic signals from the central control module 428 and/or the propulsion control module 429 rather than by physical linkages to steering devices, such as a joystick 438 and/or a steering wheel 440. Sensors 439, 441 associated with the steering devices detect the positions of these steering devices and provide electronic signals to the central control module 428 for subsequently steering the marine vessel 401 in a manner known in the art. A steering angle sensor 452 is also provided in conjunction with the steering actuator 450 to provide feedback regarding the steering angle of the first marine drive 414 at any given time in a manner known in the art. It will be recognized that the actual steering angle of the first marine drive 414 may be inferred based on the position of the steering actuator 450, for example whereby the steering angle sensor 452 is an encoder associated with the steering actuator 450.

Figure 12:
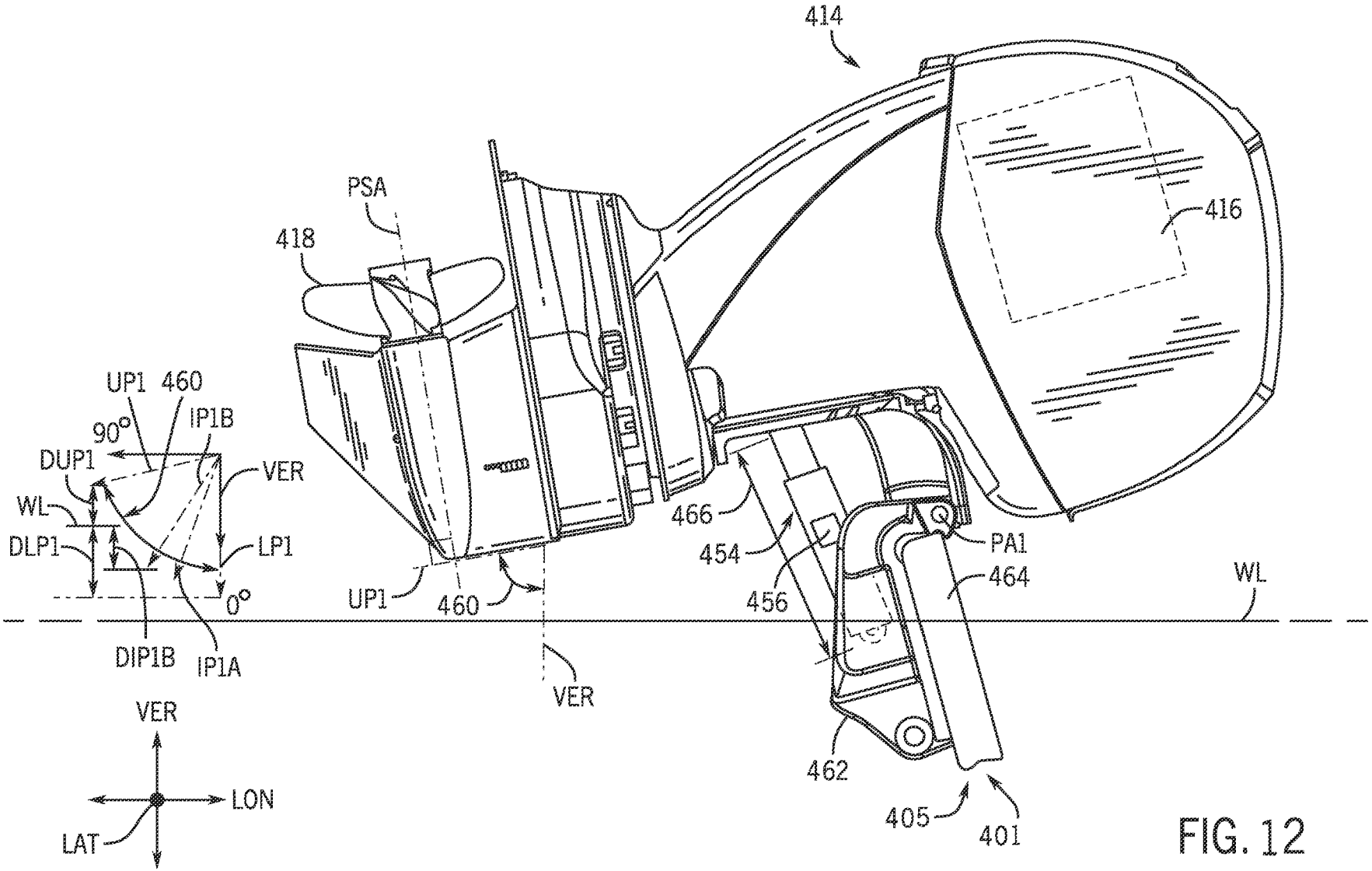
FIG. 12 is a right side view of an exemplary first marine drive such as may be incorporated with the marine vessel of FIG. 11.

Referring to FIGS. 11 and 12, the central control module 428 and/or propulsion control module 429 also communicates with a trim actuator 454 associated with the first marine drive 414. As shown, the first marine drive 414 is coupled via a transom bracket 462 to the transom 464 at the stern 405 of the marine vessel 401. The transom bracket 462 allows the first marine drive 414 to pivot relative to the transom 464, and thus relative to the vertical axis VER, about a pivot axis PA1. Operating the trim actuator 454 changes a length 466 between opposing ends of the trim actuator 454. Changing the length 466 of the trim actuator 454 causes the first marine drive 414 to pivot about the pivot axis PA1 to thereby adjust the trim angle 460 of the first marine drive 414. The trim angle 460 can be changed to position the first marine drive 414 into and between a lower position LP1 and an upper position UP1 (or "fully trimmed" position) as well as a plurality of intermediate positions therebetween (e.g., IP1A, IP1B, etc.). In certain configurations, the upper position UP1 corresponds to a trim angle 60 of between 60 and 80 degrees and the lower position LP1 corresponds to a trim angle 60 of between +10 degrees. The propulsor 136 may be mostly or entirely out of the water when in the upper position UP1. The propulsor 136 is configured to propel the marine vessel 1 in the water when in the lower position LP1 and one or more of the intermediate positions (e.g., IP1A, IP1B) between the lower position LP1 and the upper position UP1. FIG. 12 shows the first marine drive 414 in the upper position UP1 with a trim angle 460 of approximately 75 degrees relative to the vertical axis VER.

It should be recognized that changing the trim angle 460 changes the depth of the first marine drive 414 within the water. In certain configurations, the lower position LP1 corresponds to the deepest depth of the first marine drive 414 and the upper position UP1 corresponds to the shallowest depth (or the greatest height above the water line, depending on the configuration). In particular, FIG. 12 shows the first marine drive 414 (e.g., at the propeller shaft axis PSA) having an upper position depth DUP1 at the upper position UP1, a lower position depth DLP1 at the lower position LP1, and a second intermediate depth DIP1B at the second intermediate position IP1B. It should be recognized that the depth of the first marine drive 414 at the second intermediate position IP1B (second intermediate depth DIP1B) is less than the depth at the lower position LP1 (lower position depth DLP1) and greater than the depth at the upper position UP1 (upper position depth DUP1, which in this case is above the waterline WL). A first intermediate position IP1A of the first marine drive 414, which is between the lower position LP1 and the second intermediate position IP1B, will be discussed herein below. It should further be recognized that while the present disclosure principally refers to embodiments in which the depth is changed via pivoting, other configurations are also contemplated. By way of example, this includes transom jack plates for moving the propeller 418 straight up and down (i.e., parallel to the vertical direction VER) via rack and pinion or other mechanisms known in the art.

Feedback regarding the trim angle 460 of the first marine drive 414 is provided via a trim angle sensor 456. The trim actuator 454 may be of a type presently known in the art. Additional information regarding exemplary trim actuators 454 and trim angle sensors 456 is provided in U.S. Pat. Nos. 6,583,728; 7,156,709; 7,416,456; and 9,359,057, which are incorporated by reference in entirety herein. The trim angle 460 is adjustable via trim commands that may be provided by the control system 600 discussed below. By way of example, these trim commands may be provided via known auto-trim functions and/or by user input, such as through trim switches 468 or a user interface 436 at a helm 432 of the marine vessel 401.

With continued reference to FIGS. 11 and 12, the marine vessel 401 includes a number of operator input devices located at the helm 432 of the marine vessel 401, which may be used to control the first marine drive 414, the second marine drive 500, and/or other components of the marine vessel 401. The operator input devices include a multi-functional display device 434 with a user interface 436. The user interface 436 may be an interactive, touch-capable display screen, a keypad, a display screen and keypad combination, a track ball and display screen combination, or any other type of user interface known to those having ordinary skill in the art for communicating with a multi-functional display device 434. The operator input devices further include one or more steering devices, such as a steering wheel 440 and/or a joystick 438, configured to facilitate user input to control the system 410, and thus to steer the marine vessel 401. In the embodiment shown, a joystick 438 provided at the helm 432 allows an operator of the marine vessel 401 to command the marine vessel 401 to translate or rotate in any number of directions. The joystick 438 may be used to control one or both of the first marine drive 414 and the second marine drive 500 at the same time.

A steering wheel 440 is configured for providing steering commands to the first marine drive 414 and/or the second marine drive 500. It should be recognized that the steering wheel 440 or other steering devices (e.g., joystick 438, station-keeping functions, or auto-pilot functions) control steering for the marine vessel 401 via control of the steering actuators 450 discussed above. A throttle lever 442 is also configured for the user to provide thrust commands, including both a magnitude and a direction of thrust, to the central control module 428. The throttle lever 442 may be used to control the thrust for the first marine drive 414 and/or the second marine drive 500. When the throttle lever 442 is configured to control both marine drives, it may be further configured to do so one at a time and/or simultaneously. In certain embodiments, the thrust of the first marine drive 414 and/or the second marine drive 500 may also or alternatively be controlled by the joystick 438, by station-keeping and/or auto-pilot functions, and/or other mechanisms known in the art.

In this manner, several of the operator input devices at the helm 432 can be used to input an operator command for the powerhead 416 to the central control module 428, including the user interface 436 of the multi-functional display device 434, the joystick 438, and the throttle lever 442. By way of example, a rotation of the throttle lever 442 in a forward direction away from its neutral, detent position could be interpreted as a value from 0% to 100% operator demand corresponding via an input/output map, such as a look up table, to a position of the throttle valve or a setpoint for controlling the electrical power drawn by the powerhead 416. For example, the input/output map might dictate that the throttle valve is fully closed when the throttle lever 442 is in the neutral, detent position (i.e., 0% demand), and is fully open when the throttle lever 442 is pushed forward to its furthest extent (i.e., 100% demand). As discussed further below, similar methods may also be employed for controlling steering, whereby operator inputs are received from a range of −100% to +100% corresponding to full port and full starboard steering directions, which then cause corresponding steering of the first marine drive 414 and/or the second marine drive 500, in certain examples through the use of a lookup table.

With continued reference to FIG. 11, the marine vessel 401 also includes a global positioning system (GPS) 430 that provides location and speed of the marine vessel 401 to the central control module 428. Additionally, or alternatively, a vessel speed sensor such as a Pitot tube or a paddle wheel could be provided. The marine vessel 401 may also include an inertial measurement unit (IMU) or an attitude and heading reference system (AHRS) 426. An IMU has a solid state, rate gyro electronic compass that indicates the vessel heading and solid state accelerometers and angular rate sensors that sense the vessel's attitude and rate of turn. An AHRS provides 3D orientation of the marine vessel 401 by integrating gyroscopic measurements, accelerometer data, and magnetometer data. The IMU/AHRS could be GPS-enabled, in which case a separate GPS 430 may not be required.

Figure 13:
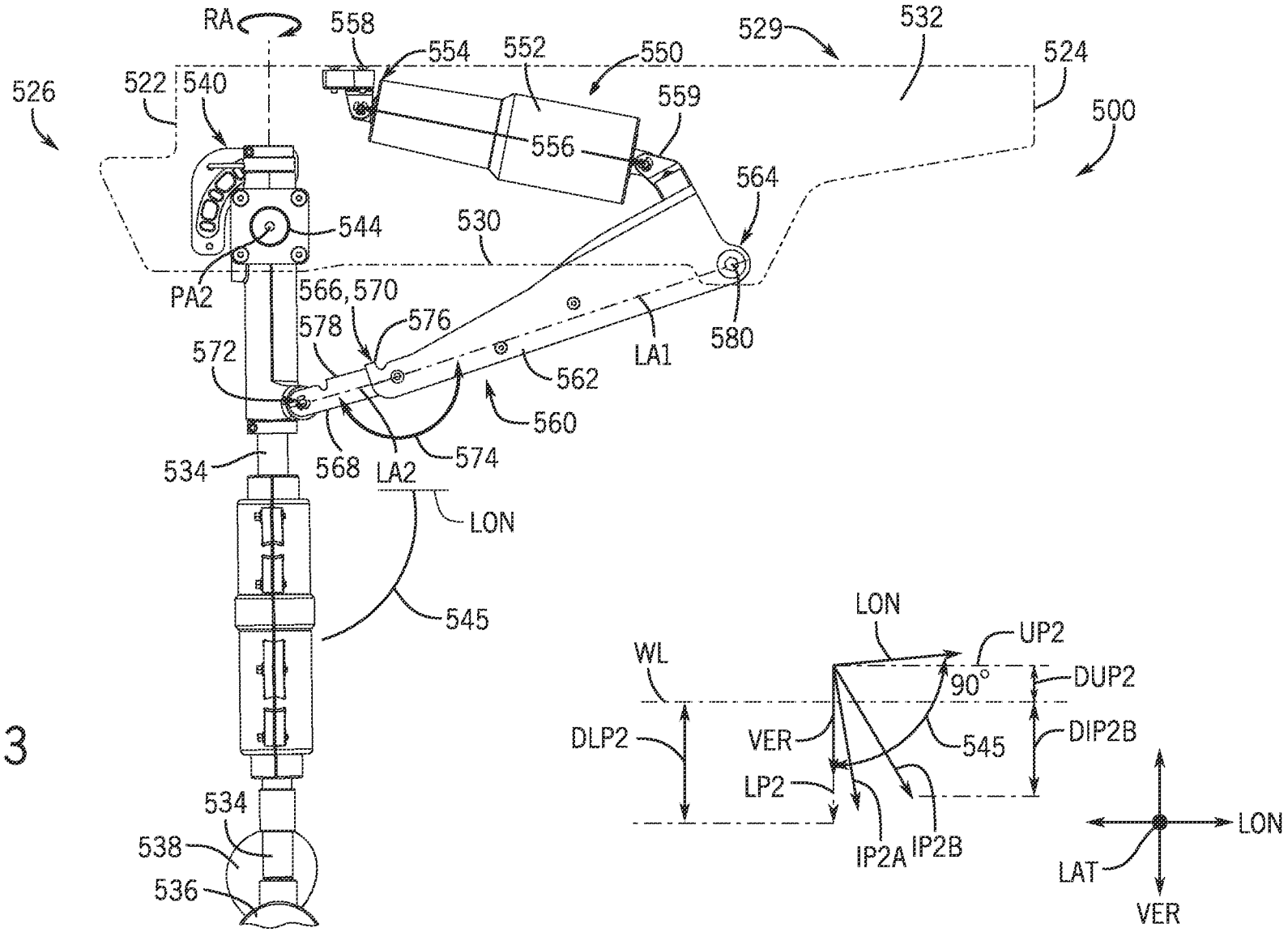
FIG. 13 is a right side view of a second marine drive such as may be incorporated with the marine vessel of FIG. 11, the second marine drive being shown in a lower position.
Figure 14:
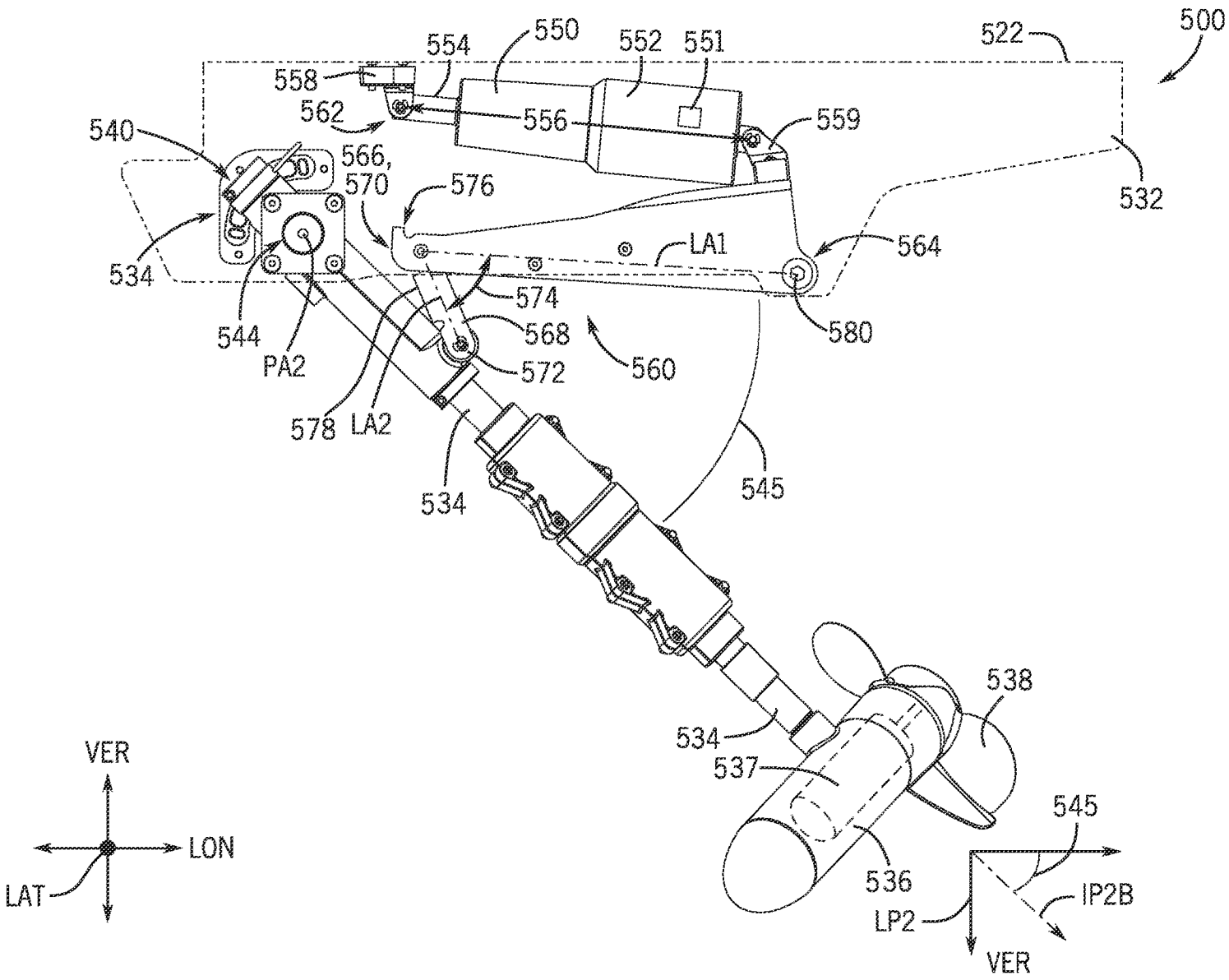
FIG. 14 is a right side view showing the second marine drive of FIG. 13 in an intermediate position.

With reference to FIGS. 13 and 14, additional information is now provided for the exemplary second marine drive 500, which is also referred to as a deployable thruster or a stowable thruster. The second marine drive 500 is coupled to the underside of the deck 402 between the pontoons 403 (FIG. 11). The second marine drive 500 includes a base 522 that extends between a front 524 and a back 526, a top 529 and a bottom 530, and sides 532. The second marine drive 500 includes a propulsor 536 that is configured to propel the marine vessel 401, such as via a motor drive 537 (e.g., an electric motor and other electronic components for powering and driving the electric motor as are conventional) rotating a propeller 538 in a customary manner. Additional information regarding the exemplary configurations for the base 522, the propulsor 536, and other aspects of the second marine drive 500 is also provided in U.S. Pat. No. 11,572,146 and U.S. Patent Pub. No. 2022/0266972, which are incorporated by reference in entirety herein.

The second marine drive 500 has an arm 534 that pivotably couples to the propulsor 536 to the base 522 via an axle 544 that extends between the sides 532 of the base 122. The propulsor 536 is pivotable via the arm 534 about a pivot axis PA2 into and between a lower position LP2 (or "fully deployed" position, shown in FIG. 13) and an upper position UP2 (or "fully stowed" position in which the propulsor 536 is nearest to the deck of the marine vessel), as well as a plurality of intermediate positions therebetween (e.g., IP2A, IP2B, etc.). The propulsor 536 may be characterized as having a pivot angle 545 relative to the horizontal axis or plane (e.g., thus being parallel to the longitudinal axis LON). By way of non-limiting example, the upper position UP2 may have a pivot angle 545 between 0 and 10 degrees and the lower position LP2 may have a pivot angle 545 between 85 and 95 degrees. The propulsor 536 may be mostly or entirely out of the water when in the upper position UP2, depending on the size of the propulsor 536, the second marine drive 500 generally, and the height of the underside of the deck of the marine vessel above the waterline WL. The propulsor 536 is configured to propel the marine vessel 401 in the water when in the lower position LP2 and one or more of the intermediate positions (e.g., IP2A) between the lower position LP2 and the upper position UP2. FIG. 14 shows the propulsor 536 in a second intermediate position IP2B that has a pivot angle 445 of approximately 60 degrees relative to the longitudinal axis LON.

In this manner, it should be recognized that the propulsor 536 is not only stowed and deployed by pivoting the arm 534, but this pivoting also controls the depth of the propulsor 536 in the water (e.g., below the waterline WL of FIG. 11). In particular, the propulsor 536 has a lower position depth DLP2 at the lower position LP2 and a second intermediate depth DIP2B at the second intermediate position IP2B (see FIG. 13). The second intermediate depth DIP2B at the second intermediate position IP2B is shallower than the lower position depth DLP2 at the lower position LP2. It should further be recognized that while the present disclosure principally refers to embodiments in which the depth of the propulsor 536 is changed via pivoting, other configurations are also contemplated. By way of example, this includes moving the propulsor straight up and down (i.e., parallel to the vertical direction VER) via rack and pinion, a scissors-type lift, or other mechanisms known in the art. For simplicity, changing the angle or depth of the propulsor 536 may also be referred to as changing the depth of the second marine drive 500 generally.

In the illustrated configuration of FIGS. 13 and 14, a gearset 540 is also operatively coupled between the arm 534 and the base 522. The gearset 540 provides for rotation of the arm 534 about its length (rotation axis RA) as the arm 534 is pivoted about the axle 544 between the upper position UP2 and the lower position LP1. Additional information regarding the exemplary configurations of gearsets 540 is provided in U.S. Pat. No. 11,572,146. While there are advantages to rotating the propulsor 536, the present disclosure also contemplates configurations in which the second marine drive 500 does not provide for rotating the propulsor 536 as it pivots into and between the upper position UP2 to the lower position LP2.

The arm 534 may be pivoted into and between the upper position UP2 and the lower position LP2 via an actuator 550, shown here to be a linear actuator of a type presently known in the art. The actuator 550 has a cylinder 552 that receives a rod 554 (FIG. 14) therein. The actuator 550 may be actuated hydraulically, pneumatically, and/or electro-mechanically to extend and retract the rod 554 within the cylinder 552, thereby changing a length 556 between opposing ends of the actuator 550. In certain configurations, the actuator 550 includes a sensor 551 (e.g., an encoder or string potentiometer, or other position sensor known in the art) that measures a position of the rod 554 relative to the cylinder 552 to determine the length 556 between opposing ends of the actuator 550 at any given time. Additional information regarding the examples for the base actuator 550 and how it may cause the arm 534 and the propulsor 536 to pivot are also provided in U.S. Pat. No. 11,572,146 and U.S. Patent App. Pub. No. 2022/0266972, as discussed above.

With continued reference to FIGS. 13 and 14, the rod 554 of the actuator 550 is pivotally coupled to the base 522 via a clevis bracket 558 using methods known in the art, such as through welds, fasteners, and/or the like. At an opposite end of the actuator 550, the cylinder 552 is pivotally coupled to an actuator linkage 560 that couples the actuator 550 to the arm 534 to provide pivoting thereof about the axle 544. The actuator linkage 560 includes a first link 562 that extends between a first end 564 and a second end 566 defining a length LA1 therebetween, as well as a second link 568 that extends between a first end 570 and a second end 572 defining a length LA2 therebetween. The first end 564 of the first link 562 is pivotally coupled to the side 532 of the base 522 of the second marine drive 500. The actuator 550 is also coupled to this first link 562, particularly via another clevis bracket 559 that is offset from the pivotal connection of the first link 562 to the sides 532 of the base 522.

The second end 566 of the first link 562 is pivotally coupled to the first end 570 of the second link 568. The second end 572 of the second link 568 is pivotally coupled to the arm 534 supporting the propulsor 536. The pivotal connections within the actuator linkage 560 may be made through methods known in the art, such as the use of bolts, pins, rivets, and/or other fasteners. It should be recognized that the first link 562 and/or the second link 568 may be comprised of one or more parallel members for stability and to prevent twisting in use.

The illustrated configuration, the pivot angle 574 between the first link 562 and the second link 568 is limited by a stop finger 576 coupled to the first link 562 engaging an edge 578 of the second link 568. The stop finger 576 may be provided via integral formation, bending, welding, fasteners, or other methods known in the art. In certain configurations, the stop finger 576 limits the pivot angle 574 between the first link 562 and the second link 568 to being between 160 and 190 degrees relative to each other. It may be particularly advantageous for the stop finger 576 to engage the edge 578 of the second link 568 at a pivot angle 574 of greater than 180 degrees when the propulsor 536 is in the lower position LP2. In particular, by configuring the actuator linkage 560 to be "over-center" (the pivot angle 574 exceeding 180 degrees), any forces exerted on the propulsor 536 or arm 534 are transferred to the contact between the stop finger 576 and the second link 568, and thus cannot be transferred to the actuator 550. This effectively locks the second marine drive 500 in the lower position LP2 (or deployed position) until the actuator 550 moves the actuator linkage 560 in an opposite direction to pivot the propulsor 536 towards the upper position UP (or stowed position).

With continued reference to FIGS. 13 and 14, further details are now provided for how the actuator 550 changes the depth of the propulsor 536, such as by moving from the upper position UP2 towards the lower position LP2. In the configuration shown, retraction of the actuator 550 (reducing the length 556 thereof) causes the actuator linkage 560 to cause the arm 534 to pivot about the axle 544 towards the deployed position. In particular, the actuator 550 causes the first link 562 to pivot about a pivot axis 580 near the first end 564 of the first link 562 (here, counter-clockwise) such that the second end 566 of the first link 562 moves downwardly, away from the base 522. The process is assisted by gravity, which provides a constant downward force on the mass of the actuator linkage 560 itself, as well as on the masses of the actuator 550 and the propulsor 536 coupled to the actuator linkage 560. It should be recognized that the actuator 550 may be positioned other than as shown, including being positioned such that extension (rather than retraction) causes rotation of the arm 534 towards the lower position LP2.

Rotation of the first link 562 allows the arm 534 to pivot downwardly towards the lower position LP2 (here, clockwise about the axle 544), supported by the second link 568 connected to the first link 562. For the configuration shown, the pivot angle 574 between the first link 562 and the second link 568 begins at less than 180 degrees (and here less than 90 degrees) when in the upper position UP2 (which is also true in the intermediate position IP2B of FIG. 14). For example, the pivot angle 574 may be 30 degrees, 45 degrees, or other angles below 180 degrees when in the upper position UP2. As the arm 534 pivots towards the lower position LP2, the pivot angle 574 increases to be 180 degrees when the propulsor 536 is nearly in the lower position LP2 (the arm 534 extending nearly vertically downwardly).

Other mechanisms for changing the depth of the second marine drive 500 relative to the water level WL are also contemplated. By way of example, this includes rotating the axle 544 coupled to the arm 534 via a rotary actuator, whereby in certain configurations the axle 544 is the shaft of the rotary actuator itself. An actuator linkage such as the actuator linkage 560 may still be incorporated for stability and support, or omitted.

In certain embodiments, the second marine drive 500 is steerable via a steering actuator 582 (FIG. 15) having a steering angle sensor 584, which may be the same or similar to the steering actuator 450 and steering angle sensor 452 discussed above with respect to the first marine drive 414. It should be recognized that just as the second marine drive 500 may be steerable, the first marine drive 414 need not be.

Figure 15:
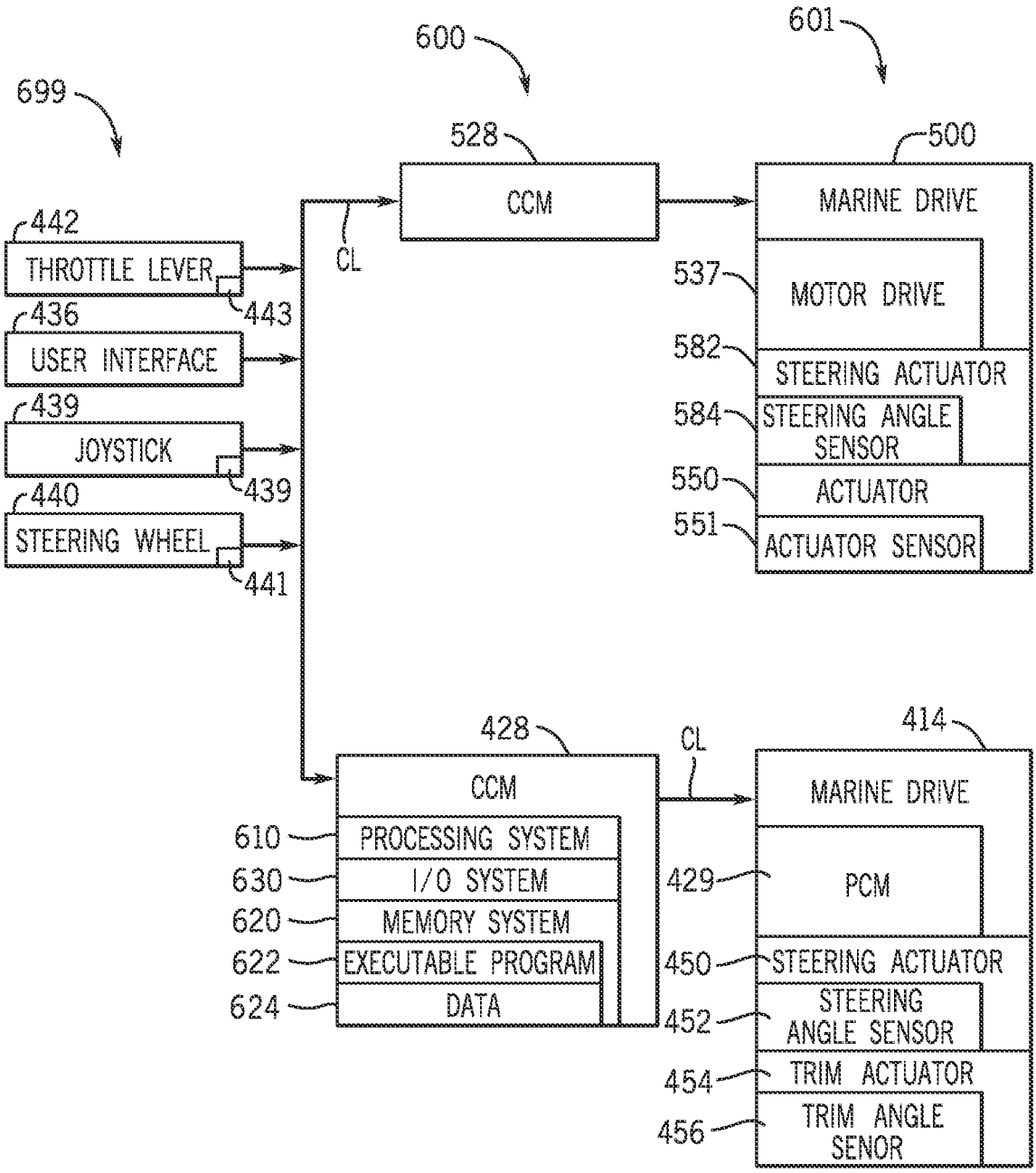
FIG. 15 is schematic view of a control system such as may be incorporated within the marine vessel of FIG. 11.

Additional information is now provided for subsystems within an exemplary central control module 428 for controlling the first marine drive 414 and/or the second marine drive 500, as shown in FIG. 15. A person of ordinary skill in the art will recognize that these subsystems may also be present within additional central control modules 428 (as applicable), and/or propulsion control modules 429 or other controllers within the marine vessel 401. In the illustrated control system 600, the central control module 428 includes a processing system 610, which may be implemented as a single microprocessor or other circuitry, or be distributed across multiple processing devices or sub-systems that cooperate to execute the executable program 622 from the memory system 620. Non-limiting examples of the processing system include general purpose central processing units, application specific processors, and logic devices. In the example shown, two central control modules 428, 528 associated with the first marine drive 414 and the second marine drive 500, respectively, together comprise a control system 600. However, as discussed above, the propulsion control module 229 and/or other controllers in alternate configurations may also be considered to be part of the control system 600.

The central control module 428 further includes a memory system 620, which may comprise any storage media readable by the processing system 610 and capable of storing the executable program 622 and/or data 624. The memory system 620 may be implemented as a single storage device, or may be distributed across multiple storage devices or sub-systems that cooperate to store computer readable instructions, data structures, program modules, or other data. The memory system 620 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example. An input/output (I/O) system 630 provides communication between the control system 600 and peripheral devices, such as input devices 699 and output devices 601, which are discussed further below. In practice, the processing system 610 loads and executes an executable program 622 from the memory system 620, accesses data 624 stored within the memory system 620, and directs the system 410 to operate as described in further detail below.

A person of ordinary skill in the art will recognize that these subsystems within the control system 600 may be implemented in hardware and/or software that carries out a programmed set of instructions. For example, a central control module may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A central control module may include memory (shared, dedicated, or group) that stores code executed by the processing system. The term "code" may include software, firmware, and/or microcode, and may refer to programs, routines, functions, classes, and/or objects. The term "shared" means that some or all code from multiple central control modules may be executed using a single (shared) processor. In addition, some or all code from multiple central control modules may be stored by a single (shared) memory. The term "group" means that some or all code from a single central control module may be executed using a group of processors. In addition, some or all code from a single central control module may be stored using a group of memories. As shown in FIG. 15, one or more central control modules 428, 528 may together constitute a control system 600. The one or more central control modules 428, 528 can be located anywhere on the marine vessel 401.

A person of ordinary skill in the art will understand in light of the disclosure that the control system 600 may include a differing set of one or more control modules, or control devices, which may include engine control modules (ECMs) for the first marine drive 414 and/or the second marine drive 500 (which may be referred to as ECMs even if the corresponding marine drive contains an electric motor in addition to or in place of an internal combustion engine), one or more thrust vector control modules (TVMs), one or more helm control modules (HCMs), and/or the like. Likewise, certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices.

The control system 600 communicates with each of the one or more components of the marine vessel 401 via a communication link CL, which can be any wired or wireless link. The illustrated communication link CL connections between functional and logical block components are merely exemplary, which may be direct or indirect, and may follow alternate pathways. The control system 600 is capable of receiving information and/or controlling one or more operational characteristics of the marine vessel 401 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the marine vessel 401. Moreover, the communication link CL lines are meant only to demonstrate that the various control elements are capable of communicating with one another, and do not represent actual wiring connections between the various elements, nor do they represent the only paths of communication between the elements. Additionally, the marine vessel 401 may incorporate various types of communication devices and systems, and thus the illustrated communication links CL may in fact represent various different types of wireless and/or wired data communication systems.

With continued reference to FIG. 15, the control system 600 communicates with input devices 499 from various components such as the joystick 438 (FIG. 11) or a steering wheel 440 discussed above, in particular via the sensor 439 or the sensor 441 corresponding thereto, respectively. The control system 600 also communicates with other operator input devices, such as the throttle lever 442 via its sensor 443, or the user interface 436, such as by setting a route or destination using the GPS 430 or other systems discussed above. The control system 600 also communicates with output devices 601 such as the propulsion control module 429, the steering actuator 450, and the trim actuator 454 discussed above. It will be recognized that the arrows shown are merely exemplary and that communication may flow in multiple directions. For example, the steering angle sensors 452, 584, the trim angle sensor 456, and the actuator sensor 551, while shown as corresponding to the steering actuators 450, 582, the trim actuator 454, and the actuator 550, may serve as input devices 499 feeding into the one or more central control modules 428, 528.

Although FIG. 11 showed one central control module 428, it will be recognized that more than one central control module may work together serially and/or in parallel, such as one central control module for each of the marine drives as shown in FIG. 15. Portions of the methods disclosed herein below can be carried out by a single central control module or by several separate control modules communicatively connected and cooperating to provide steering and propulsion control for the marine vessel 401, such as based on user input at a steering device 438, 440 at the helm 432. For example, the one or more central control modules 428 and/or 528 may be communicatively connected to a propulsion control module 429 associated with each of the first marine drive 414 and the second marine drive 500. If more than one central control module is provided, each can control operation of a specific device or sub-system on the marine vessel.

Through experimentation and development, the present inventors have recognized issues with stowable thrusters known in the art, including those used as bow thrusters near the bow of a marine vessel or as stern thrusters near the stern of a marine vessel. Stowable thrusters known in the art have only a single deployment setpoint. The thruster is either stowed (unable to propel the marine vessel), or fully deployed. This is particularly problematic when the marine vessel is operated in shallow water or near underwater obstacles such as trailer or shore station bunks. In these situations, it is possible to trim up a conventional primary marine drive, such as an outboard or sterndrive motor, to avoid contacting the ground and thus damaging the marine drive. However, as stated above, no depth-based accommodations can be made for the conventional thruster, which is either fully stowed or fully deployed.

For simplicity, the stowable thruster is referred to herein as the second marine drive, whereas the primary marine drive (e.g., a sterndrive or an outboard) is referred to as the first marine drive. The present inventors have developed the presently disclosed systems 410 and methods for controlling the first marine drive and the second marine drive to prevent this damage to thrusters when situated in shallow water and/or near underwater obstacles. With reference to FIG. 15 and the components discussed above, in certain configurations the control system 600 is configured to change the depth of the second marine drive 500 via the second actuator 550 based on the trim angle 460 (FIG. 12) of the first marine drive 414 to prevent damage to the second marine drive 500. Explained in another manner, the system 410 provides for deploying the second marine drive 500 to a depth other than simply the lower position LP2 (the deepest or "fully deployed" position, FIGS. 13 and 14), here, on the basis of the trim angle 460 of the first marine drive 414. This ensures that whenever the trim angle 460 of the first marine drive 414 is adjusted to protect the first marine drive 414, the second marine drive 500 is correspondingly protected. As discussed above, the trim angle 460 may be adjusted in accordance with trim commands provided by the user (e.g., via trim switches 468 or a user interface 436 at a helm 432 of the marine vessel 401 as shown in FIG. 11), and/or via the control system 600 itself (e.g., auto-trim functions).

In certain embodiments, a lookup table and/or algorithm is stored within the data 624 in the memory system 620 of the control system 600. The trim angle 460 of the first marine drive 414, as read by the trim angle sensor 456, is an input to the lookup table and/or algorithm. The control system 600 then determines the corresponding maximum depth for positioning the second marine drive 500 based on the lookup table and/or algorithm. In other words, the lookup table, algorithm, or other control mechanism stored in the data 624 determines the deepest allowable position for the second marine drive 500 as a function of the trim angle 460 of the first marine drive 414, though other factors may modify this maximum depth and/or the maximum depth may be overridable by the user. As discussed above, the deepest allowable position for deploying the second marine drive 500 need not always correspond to its lowest position LP2, which is the setpoint for fully deploying the second marine drive 500 if there are no concerns with water depth.

The maximum depth may be represented as the pivot angle 545 of the arm 534 supporting the propulsor 536 of the second marine drive 500, particularly in configurations in which the depth is adjusted by pivoting the arm 534 to change the depth of the propulsor 536. The control system 600 then controls the second actuator 550 as needed such that the depth of the second marine drive 500 does not exceed that maximum depth. By way of example, increasing the trim angle 460 of the first marine drive 414 by 1 degree may cause the second actuator 550 to decrease the pivot angle 545 of the propulsor 536 for the second marine drive 500 by 1 degree, 2 degrees, 0.5 degrees, or other ratios or multipliers. It should be recognized that the relationship between increasing the trim angle 460 of the first marine drive 414 and the pivot angle 545 for the second marine drive 500 may depend upon the lengths of the corresponding marine drives, the height in which each is positioned and/or pivotable above the waterline WL, and the like.

In certain configurations, trim thresholds are employed such that not every change to the trim angle 460 of the first marine drive 414 need cause a change in the pivot angle 545 of the second marine drive 500. The present inventors have recognized that this avoids unnecessary overuse of the second actuator 550, as well as the additional noise, harshness, and/or vibration of operating the second actuator 550 when adjustment to the depth of the second marine drive 500 is not needed.

In one example, an intermediate position is selected as the trim threshold (e.g., the first intermediate position IP1A shown in FIG. 12) for the first marine drive 414 and is stored in the memory system 620 of the control system 600 for subsequent access and comparison. By way of example, the trim threshold may be 20 degrees relative to the vertical axis VER. Other trim thresholds may include 10, 30, or 45 degrees. The control system 600 is configured to access the stored trim threshold, compare the trim angle of the first marine drive 414 to the trim threshold, and to change the depth of the second marine drive 500 based on the trim angle 460 of the first marine drive 414 only when the trim angle 460 of the first marine drive 414 is at or above this first intermediate position IP1A. In other words, in the illustrated example, the control system 600 changes the depth of the second marine drive 500 only when the trim angle 460 of the first marine drive 414 is determined to be between the first intermediate position IP1A (the trim threshold) and the upper position UP1. This provides that the depth of the second marine drive 500 is not changed, at least on the basis of the trim angle of the first marine drive 414 changing, until the depth of the first marine drive 414 (via the trim angle 460 thereof) has been increased enough from the lower position LP.

In a further example, the control system 600 is further configured such that the pivot angle 545 of the second marine drive 500 is decreased again (e.g., is moved to its lower position LP2) once the trim angle 460 of the first marine drive 414 is again less than the trim threshold. In this manner, the control of the second marine drive 500 automatically restores the fully deployed position thereof once the risk of damage is deemed to be resolved. It should be recognized that the control system 600 may compare the trim angle of the first marine drive and/or the pivot angle of the second marine drive to multiple thresholds to accomplish the different functions described herein.

Certain embodiments may also provide for a minimum depth threshold to be determined for the second marine drive 500 via a lookup table, algorithm, or other mechanism. The minimum depth threshold is the minimum depth for deploying the second marine drive 500 so as to be able to propel the marine vessel in the water. By way of example, the minimum depth may be set to correspond to the center of the propeller being at least 6 inches below the waterline WL, determined by knowing the actual or nominal height for installing the second marine drive 500 on the underside of the marine vessel's deck, along with the pivot angle 545, the length of the arm 534, etc. If the maximum depth determined by the control system 600, based at least in part on the trim angle 460 of the first marine drive 414, is less than the minimum depth threshold, the second marine drive 500 is fully stowed or moved to another position (i.e., shallower than the maximum depth) rather than changing the depth to the maximum depth. For example, the second marine drive 500 may be caused to be fully stowed whenever the trim angle of the first marine drive 414 is 60 degrees or greater from the vertical axis VER. Alternatively, the control system 600 may move the second marine drive 500 to the minimum depth threshold when the first marine drive 414 is 60 degrees or greater from the vertical axis VER.

The present disclosure also contemplates configurations in which the depth of the second marine drive 500 is changeable manually, including to intermediate positions other than the upper position UP2 and the lower position LP2. The depth of the second marine drive 500 may be manually adjusted in accordance with depth commands provided by the user, such as via depth switches 469 or a user interface 436 at a helm 432 of the marine vessel 401 (FIG. 11). The depth command may be provided as an angle, a percentage, or a vertical distance. Additionally, the depth may be changed in accordance with other control parameters of the control system 900, for example based on depth charts stored in the memory system 920 in accordance with the location of the marine vessel 401 as determined by the GPS 430. Likewise, a depth gauge 489 (e.g., a sonar sensor, FIG. 11) may be used to determine the depth of the marine vessel 401 and be used by the control system 600 to vary control of at least the second marine drive 500. For example, if the control system 600 determines that the depth of the water from the depth gauge 489 exceeds a minimum threshold (e.g., 10 feet), no adjustment to the depth of the second marine drive 500 is made even if the first marine drive 414 is trimmed up, recognizing that no damage will result to the second marine drive 500.

The control system 600 may also provide for other control of one marine drive as a function of the other. By way of example, this may include preventing the first marine drive 414 and the second marine drive 500 from simultaneously propelling the marine vessel 401 in the water. In certain examples, operating the first marine drive 414 to propel the marine vessel 401, which may be subject to a minimum speed threshold such as 5 MPH, may cause the second marine drive 500 to automatically reduce depth, or to move entirely to the upper position UP2 (i.e., to be stowed).

In certain configurations, the system 410 may be operated according to different operating modes, which may be selectable at the helm 432. These operating modes may include "enabled" and "disabled" modes in which the second marine drive 500 is controlled and not controlled based on the trim angle of the first marine drive 414, respectively. Another operating mode (e.g., an "independent control" mode) provides that the depth of the second marine drive 500 is controlled by the control system 600, but does not include the trim angle 460 of the first marine drive 414 as a basis for this control. For example, the depth of the second marine drive 500 in independent control mode is still controlled based on the readings of the depth gauge 489 and/or location of the marine vessel 401 from the GPS 430, but not controlled as a function of the trim angle of the first marine drive 414.

As discussed above, the depth of the second marine drive 500 may also be manually controlled (e.g., via the depth switches 469 at the helm 432), including to override any of the other automated controls from the control system 600 discussed herein. Manual override may require the user to acknowledge the risks associated with manual control via prompts on the user interface 436 and/or may result in visual, audible, or tactile warnings. Similarly, visual, audible, or tactile notifications may be provided at the helm 432 when the depth of the second marine drive 500 is changed more generally.

In certain embodiments, the control system 600 is configured to provide these visual, audible, or tactile notifications to the user to accept a recommended change in the depth of the second marine drive 500 based on the trim angle of the first marine drive 414 and/or other factors as discussed herein above. In certain embodiments, these additional factors may include the detection of an object strike. For example, if the actuator of the second marine drive detects an object strike (e.g., via a sudden change in position other than via the movement of the actuator) this may cause the depth of the second marine drive 500 to be reduced so as to avoid further object strikes. The control system 600 may then execute the change in depth of the second marine drive 500 upon acceptance by the user. Alternatively, the control system 600 may be configured such that the user adjusts the depth of the second marine drive 500 to meet the recommended change in depth, for example until the visual, audible, or tactile notifications provide that the depth of the second marine drive 500 has been appropriately changed.

Figure 16:
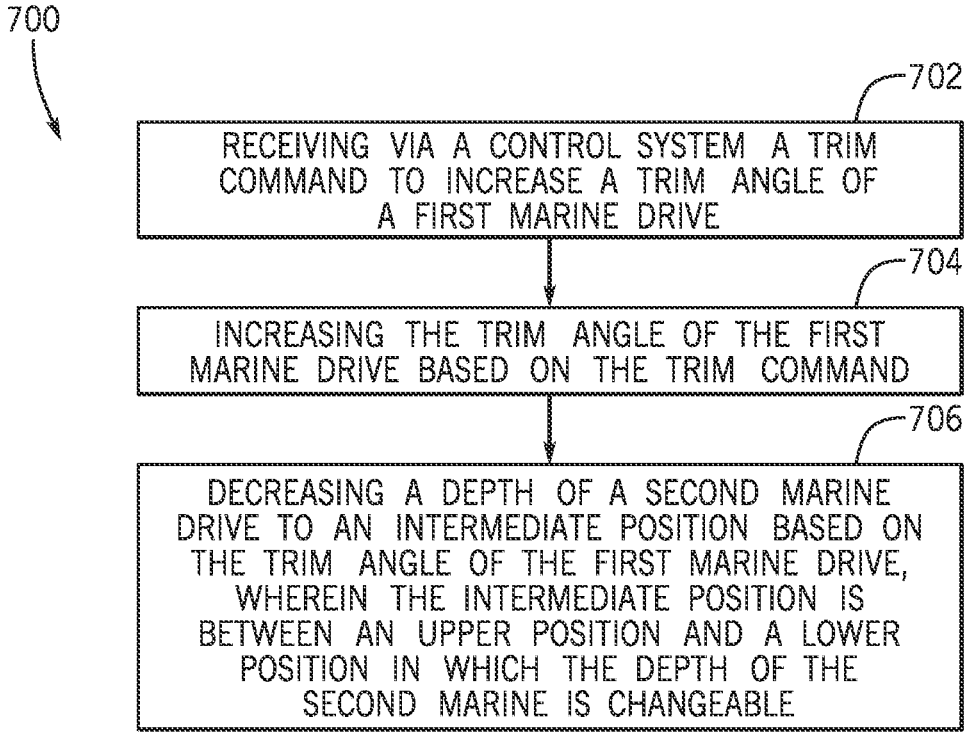
FIG. 16 is a flow chart of another exemplary method for controlling marine drives according to the present disclosure.

With concurrent reference to FIG. 11, FIG. 16 shows an exemplary method 700 for controlling marine drives according to the present disclosure, which includes some of the steps and involves some of the components discussed above. Step 702 provides for receiving via a control system a trim command to increase a trim angle of a first marine drive. As discussed above, the trim command may be received by trim switches 468 at the helm 432, auto-trim controls within the control system, and/or other mechanisms. Step 704 provides for increasing the trim angle of the first marine drive based on the trim command, which may be effectuated by control of an actuator such as the trim actuator 454 discussed above. Step 706 provides for decreasing a depth of a second marine drive to an intermediate position based the trim angle of the first marine drive. The intermediate position is between an upper position and a lower position in which the depth of the second marine drive is changeable. Additionally, the second marine drive is configured to propel the marine vessel in the water in the lower position as well as in the intermediate position.

As discussed above, changing the depth of the second marine drive may be effectuated via control of the actuator 550 (FIGS. 13-14) discussed above or other mechanisms known in the art. The mechanism for adjusting the depth of the second marine drive may vary depending on the configuration of the second marine drive. As discussed above, the second marine drive may be pivotable or may be vertically translatable, or may be depth-adjusted by other mechanisms such as a scissors-lift type connection between the propulsor of the second marine drive and the deck or hull of the marine vessel.

The present disclosure therefore provides for a marine vessel 401 configured to be situated in water. The marine vessel 401 comprises a first marine drive 414 and a second marine drive 500 each configured to propel the marine vessel 401 in the water. A first actuator 454 is configured to change a trim angle 460 of the first marine drive 414 in the water. A second actuator 550 is configured to change a depth of the second marine drive 500 in the water. A control system 600 is operatively connected to the first actuator 454 and the second actuator 550. The control system 600 is configured to change the depth of the second marine drive 500 via the second actuator 550 based on the trim angle 460 of the first marine drive 414 to prevent damage to the second marine drive 500.

According to some aspects, the first marine drive 414 comprises at least one outboard motor and the second marine drive 500 comprises a stowable thruster.

According to some aspects, the first marine drive 414 is positioned near a stern 405 of the marine vessel 401 and the second marine drive 500 is positioned near a bow 404 of the marine vessel 401.

According to some aspects, the control system 600 is operably connected to the first marine drive 414 and the second marine drive 500, and the control system 600 is configured to prevent the first marine drive 414 and the second marine drive 500 from simultaneously propelling the marine vessel 401.

According to some aspects, the second actuator 550 is configured to change the depth of the second marine drive 500 to an upper position UP2, a lower position LP2 that is deeper in the water than the upper position UP2, and least one intermediate position IP2A, IP2B therebetween.

According to some aspects, the second marine drive 500 is configured to propel the marine vessel 401 in each of the lower position LP2 and the intermediate position IP2A, IP2B.

According to some aspects, the first actuator 454 is configured to change the trim angle 460 of the first marine drive 414 to an upper position UP1, a lower position LP1, and an intermediate position IP1A, IP1B therebetween.

According to some aspects, the first actuator 454 is configured to change the trim angle 460 of the first marine drive 414 to an upper position UP1, a lower position LP1, and an intermediate position IP1A therebetween, and the control system 600 is configured to change the depth of the second marine drive 500 based on the trim angle 460 of the first marine drive 414 only when the trim angle 460 of the first marine drive 414 is at or between the intermediate position IP1A and the upper position UP1.

According to some aspects, the control system 600 is configured to receive a trim command from a user to change the trim angle 460 of the first marine drive 414.

According to some aspects, the control system 600 is configured to receive a depth command from the user to change the depth of the second marine drive 500.

According to some aspects, the second actuator 550 pivots the second marine drive 500 to change the depth thereof.

According to some aspects, the depth of the second marine drive 500 is changeable into and between an upper position UP2 that is out of the water and a lower position LP2 that is in the water.

The present disclosure also provides for a method for changing via a control system 600 a first marine drive 414 and a second marine drive 500 for a marine vessel 401 configured to be situated in water, a trim angle 460 of the first marine drive 414 being changeable, and a depth of the second marine drive 500 being changeable into and between an upper position UP2 and a lower position LP2 with intermediate positions IP2A, IP2B therebetween. The method comprises receiving via the control system 600 a trim command to increase the trim angle 460 of the first marine drive 414; increasing the trim angle 460 of the first marine drive 414 based on the trim command; and decreasing a depth of the second marine drive 500 to one of the intermediate positions IP2A, IP2B based on the trim angle 460 of the first marine drive 414 so as to prevent damage to the second marine drive 500.

According to some aspects, the method further comprises operating the second marine drive 500 while in the one of the intermediate positions IP2A, IP2B to propel the marine vessel 401.

According to some aspects, the method further comprises comparing the trim angle 460 of the first marine drive 414 to a trim threshold and decreasing the depth of the second marine drive 500 based on the trim angle 460 of the first marine drive 414 only when the trim angle is 460 greater than the trim threshold.

According to some aspects, the method further comprises increasing the depth of the second marine drive 500 when the trim angle 460 of the first marine drive 414 is less than the trim threshold after being greater than the trim threshold.

According to some aspects, the trim command is a first trim command, and the method further comprises receiving a second trim command to decrease the trim angle 460 of the first marine drive 414, decreasing the trim angle 460 of the first marine drive 414 based on the second trim command, and increasing the depth of the second marine drive 500 based on the trim angle 460 of the first marine drive 414.

According to some aspects, the method further comprises accessing a stored lookup table for changing the depth of the second marine drive 500 based on the trim angle 460 of the first marine drive 414 when changing the depth of the second marine drive 500.

According to some aspects, the trim angle 460 of the first marine drive 414 is changeable into and between an upper position UP1 and a lower position LP1, and the method further comprises changing the depth of the second marine drive 500 to the upper position UP2 when the trim angle 460 of the first marine drive 414 is in the upper position UP1.

According to some aspects, the trim command is receivable from a user, and the control system 600 is further configured to receive a depth command for changing the depth of the second marine drive 500 other than based on the trim angle 460 of the first marine drive 414.

Although the present examples were described with respect to a pontoon boat, the present systems and methods can also be used on catamarans, boats with V-shaped hulls, or boats with any other type of hull capable of supporting a primary propulsion device and auxiliary propulsion device (s).

Note that any of the methods described with respect to FIGS. 1-10 could be employed by the system described with respect to FIGS. 11-16, and any of the methods described with respect to FIGS. 11-16 could be employed by the system of FIGS. 1-10.

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

What is claimed is:

1. A method for a marine vessel, the method being carried out by a vessel control system and comprising:

determining if a first propulsion device on the marine vessel is rotated about a horizontal tilt/trim axis above a predetermined threshold;

determining if a second propulsion device on the marine vessel is deployed; and if the second propulsion device is deployed, retracting the second propulsion device in response to determining that the first propulsion device is rotated above the predetermined threshold.

2. The method of claim 1, wherein the first propulsion device is a primary propulsion device configured to produce power up to a given first threshold, and the second propulsion device is an auxiliary propulsion device configured to produce power up to a given second threshold that is less than the given first threshold.

3. The method of claim 1, wherein the first propulsion device is an outboard motor or a stern drive and the second propulsion device is a thruster.

4. The method of claim 1, wherein the predetermined threshold is a rotational position about the tilt/trim axis at which a skeg on the first propulsion device is level with a keel of the marine vessel.

5. The method of claim 1, further comprising determining if the second propulsion device is deployed in response to receiving a command to change a rotational position of the first propulsion device about the tilt/trim axis.

6. The method of claim 1, wherein retracting the second propulsion device comprises moving a thrust-producing portion of the second propulsion device closer to a hull of the marine vessel.

7. A method for a marine vessel, the method being carried out by a vessel control system and comprising:

determining if a first propulsion device on the marine vessel is rotated about a horizontal tilt/trim axis above a predetermined threshold;

determining if a second propulsion device on the marine vessel is deployed; and if the second propulsion device is not deployed, prohibiting the second propulsion device from being deployed in response to determining that the first propulsion device is rotated above the predetermined threshold.

8. The method of claim 7, further comprising receiving a command to deploy the second propulsion device from a user input device.

9. The method of claim 8, wherein the user input device is a button on a joystick.

10. The method of claim 8, further comprising deploying the second propulsion device in response to the command to deploy the second propulsion device if the first propulsion device is rotated below the predetermined threshold.

11. The method of claim 8, further comprising generating an alert in response to the command to deploy the second propulsion device if the first propulsion device is rotated above the predetermined threshold.

12. The method of claim 7, wherein the first propulsion device is a primary propulsion device configured to produce power up to a given first threshold, and the second propulsion device is an auxiliary propulsion device configured to produce power up to a given second threshold that is less than the given first threshold.

13. The method of claim 7, wherein the first propulsion device is an outboard motor or a stern drive and the second propulsion device is a thruster.

14. The method of claim 7, wherein the predetermined threshold is a rotational position about the tilt/trim axis at which a skeg on the first propulsion device is level with a keel of the marine vessel.

15. The method of claim 7, further comprising determining if the second propulsion device is deployed in response to receiving a command to change a rotational position of the first propulsion device about the tilt/trim axis.

16. A method for a marine vessel, the method being carried out by a vessel control system and comprising:

determining if a primary propulsion device on the marine vessel is rotated about a horizontal tilt/trim axis above a predetermined threshold;

determining if an auxiliary propulsion device on the marine vessel is deployed;

retracting the auxiliary propulsion device in response to determining that the auxiliary propulsion device is deployed and the primary propulsion device is rotated above the predetermined threshold;

receiving a command to deploy the auxiliary propulsion device; and overriding the command to deploy the auxiliary propulsion device in response to determining that the auxiliary propulsion device is not deployed and the primary propulsion device is rotated above the predetermined threshold.

17. The method of claim 16, further comprising deploying the auxiliary propulsion device in response to the command to deploy the auxiliary propulsion device and in response to determining that the primary propulsion device is rotated below the predetermined threshold.

18. The method of claim 16, further comprising generating an alert in response to the command to deploy the auxiliary propulsion device and in response to determining that the primary propulsion device is rotated above the predetermined threshold.

19. The method of claim 16, wherein the primary propulsion device is an outboard motor or a stern drive located proximate a stern of the marine vessel and the auxiliary propulsion device is a thruster located proximate a bow of the marine vessel.

* * * * *